US008641476B2

(12) United States Patent
Duescher

(10) Patent No.: US 8,641,476 B2
(45) Date of Patent: Feb. 4, 2014

(54) COPLANAR ALIGNMENT APPARATUS FOR ROTARY SPINDLES

(76) Inventor: Wayne O. Duescher, Roseville, MN (US)

( * ) Notice: Subject to any disclaimer, the term of this patent is extended or adjusted under 35 U.S.C. 154(b) by 259 days.

(21) Appl. No.: 13/370,246

(22) Filed: Feb. 9, 2012

(65) Prior Publication Data

US 2013/0090039 A1 Apr. 11, 2013

Related U.S. Application Data

(63) Continuation-in-part of application No. 13/351,415, filed on Jan. 17, 2012, which is a continuation-in-part of application No. 13/280,983, filed on Oct. 25, 2011, which is a continuation-in-part of application No. 13/267,305, filed on Oct. 6, 2011.

(51) Int. Cl.
*B24B 7/22* (2006.01)
*B24B 49/12* (2006.01)

(52) U.S. Cl.
CPC .. *B24B 49/12* (2013.01); *B24B 7/22* (2013.01)
USPC ..... 451/6; 451/5; 451/288

(58) Field of Classification Search
CPC ..... B24B 7/22; B24B 37/10; B24B 37/107; B24B 7/228; B24B 49/12
USPC ..... 451/5, 11, 28, 36, 37, 41, 59, 64, 259, 451/260, 270, 271, 280, 283, 285, 288, 287, 451/6
See application file for complete search history.

(56) References Cited

U.S. PATENT DOCUMENTS

| | | | |
|---|---|---|---|
| 4,593,495 | A | 6/1986 | Kawakami et al. |
| 4,918,870 | A | 4/1990 | Torbert et al. |
| 5,014,468 | A | 5/1991 | Ravipati et al. |
| 5,205,082 | A | 4/1993 | Shendon et al. |
| 5,314,513 | A | 5/1994 | Miller et al. |
| 5,364,655 | A | 11/1994 | Nakamura et al. |
| 5,569,062 | A | 10/1996 | Karlsrud |
| 5,643,067 | A | 7/1997 | Katsuoka et al. |
| 5,769,697 | A | 6/1998 | Nishio |
| 5,800,254 | A | 9/1998 | Motley et al. |
| 5,863,306 | A | 1/1999 | Wei et al. |
| 5,910,041 | A | 6/1999 | Duescher |
| 5,916,009 | A | 6/1999 | Izumi et al. |
| 5,964,651 | A | 10/1999 | Hose |
| 5,967,882 | A | 10/1999 | Duescher |
| 5,975,997 | A | 11/1999 | Minami |
| 5,989,104 | A | 11/1999 | Kim et al. |

(Continued)

*Primary Examiner* — Robert Rose
(74) *Attorney, Agent, or Firm* — Mark A. Litman & Associates, P.A.

(57) ABSTRACT

There are three flat-surfaced rotary workpiece abrasive lapping spindles that are spaced apart from each other in a circle and are attached to the flat surface of a granite lapping machine base. Flat-surfaced workpieces are attached to the flat rotary surfaces of the workpiece spindles. Flexible abrasive disks are attached to the annular abrading surface of a rotary platen that is positioned to be concentric with the three spaced workpiece spindles. The platen is moved where the disk abrasive surface contacts the workpieces that are attached to the workpiece spindles. Both the platen and the workpieces spindles are rotated at high speeds to flat lap the exposed surfaces of the workpieces. A laser alignment device having laser distance sensors is attached to one of the rotary workpiece spindles. These laser alignment distance sensors are used to co-planar align the top flat surfaces of all of the workpiece spindles.

20 Claims, 11 Drawing Sheets

(56) References Cited

U.S. PATENT DOCUMENTS

| | | | | |
|---|---|---|---|---|
| 5,993,298 | A | 11/1999 | Duescher | |
| 6,001,008 | A | 12/1999 | Fujimori et al. | |
| 6,048,254 | A | 4/2000 | Duescher | |
| 6,077,153 | A * | 6/2000 | Fujita et al. | 451/259 |
| 6,089,959 | A | 7/2000 | Nagahashi | |
| 6,102,777 | A | 8/2000 | Duescher et al. | |
| 6,120,352 | A | 9/2000 | Duescher | |
| 6,149,506 | A | 11/2000 | Duescher | |
| 6,165,056 | A | 12/2000 | Hayashi et al. | |
| 6,168,506 | B1 | 1/2001 | McJunken | |
| 6,217,433 | B1 | 4/2001 | Herrman et al. | |
| 6,371,838 | B1 | 4/2002 | Holzapfel | |
| 6,398,906 | B1 | 6/2002 | Kobayashi et al. | |
| 6,425,809 | B1 * | 7/2002 | Ichimura | 451/287 |
| 6,439,965 | B1 | 8/2002 | Ichino et al. | |
| 6,506,105 | B1 | 1/2003 | Kajiwara et al. | |
| 6,607,157 | B1 | 8/2003 | Duescher | |
| 6,752,700 | B2 | 6/2004 | Duescher | |
| 6,769,969 | B1 * | 8/2004 | Duescher | 451/59 |
| 6,786,810 | B2 | 9/2004 | Muilenburg et al. | |
| 6,893,332 | B2 | 5/2005 | Castor | |
| 6,896,584 | B2 | 5/2005 | Perlov et al. | |
| 6,899,603 | B2 | 5/2005 | Homma et al. | |
| 6,935,013 | B1 | 8/2005 | Markevitch et al. | |
| 7,001,251 | B2 | 2/2006 | Doan et al. | |
| 7,008,303 | B2 | 3/2006 | White et al. | |
| 7,014,535 | B2 | 3/2006 | Custer et al. | |
| 7,029,380 | B2 | 4/2006 | Horiguchi et al. | |
| 7,033,251 | B2 | 4/2006 | Elledge | |
| 7,044,838 | B2 | 5/2006 | Maloney et al. | |
| 7,125,313 | B2 | 10/2006 | Zelenski et al. | |
| 7,144,304 | B2 | 12/2006 | Moore | |
| 7,147,541 | B2 | 12/2006 | Nagayama et al. | |
| 7,166,016 | B1 | 1/2007 | Chen | |
| 7,250,368 | B2 | 7/2007 | Kida et al. | |
| 7,276,446 | B2 | 10/2007 | Robinson et al. | |
| 7,357,699 | B2 | 4/2008 | Togawa et al. | |
| 7,367,867 | B2 | 5/2008 | Boller | |
| 7,393,790 | B2 | 7/2008 | Britt et al. | |
| 7,422,634 | B2 | 9/2008 | Powell et al. | |
| 7,446,018 | B2 | 11/2008 | Brogan et al. | |
| 7,456,106 | B2 | 11/2008 | Koyata et al. | |
| 7,470,169 | B2 | 12/2008 | Taniguchi et al. | |
| 7,491,342 | B2 | 2/2009 | Kamiyama et al. | |
| 7,507,148 | B2 | 3/2009 | Kitahashi et al. | |
| 7,520,800 | B2 | 4/2009 | Duescher | |
| 7,527,722 | B2 | 5/2009 | Sharan | |
| 7,582,221 | B2 | 9/2009 | Netsu et al. | |
| 7,614,939 | B2 | 11/2009 | Tolles et al. | |
| 7,632,434 | B2 | 12/2009 | Duescher | |
| 8,062,098 | B2 | 11/2011 | Duescher | |
| 2005/0118939 | A1 | 6/2005 | Duescher | |
| 2008/0299875 | A1 | 12/2008 | Duescher | |
| 2011/0223835 | A1 | 9/2011 | Duescher | |
| 2011/0223836 | A1 | 9/2011 | Duescher | |
| 2011/0223838 | A1 | 9/2011 | Duescher | |

* cited by examiner

COPLANAR ALIGNMENT APPARATUS FOR ROTARY SPINDLES

CROSS REFERENCE TO RELATED APPLICATION

This invention is a continuation-in-part of U.S. patent application Ser. No. 13/351,415 filed Jan. 17, 2012 that is a continuation-in-part of U.S. patent application Ser. No. 13/280,983 filed Oct. 25, 2011 that is a continuation-in-part of U.S. patent application Ser. No. 13/267,305 filed Oct. 6, 2011 that discloses subject matter that is novel and unobvious over the technical field-related technology disclosed in U.S. patent application Ser. No. 13/207,871 filed Aug. 11, 2011 that is a continuation-in-part of U.S. patent application Ser. No. 12/807,802 filed Sep. 14, 2010 that is a continuation-in-part of U.S. patent application Ser. No. 12/799,841 filed May 3, 2010, which is in turn a continuation-in-part of the U.S. patent application Ser. No. 12/661,212 filed Mar. 12, 2010. These are each incorporated herein by reference in their entirety.

BACKGROUND OF THE INVENTION

1 Field of the Invention

The present invention relates to the field of abrasive treatment of surfaces such as grinding, polishing and lapping. In particular, the present invention relates to a high speed lapping system that provides simplicity, quality and efficiency to existing lapping technology using multiple floating platens.

Flat lapping of workpiece surfaces used to produce precision-flat and mirror smooth polished surfaces is required for many high-value parts such as semiconductor wafer and rotary seals. The accuracy of the lapping or abrading process is constantly increased as the workpiece performance, or process requirements, become more demanding. Workpiece feature tolerances for flatness accuracy, the amount of material removed, the absolute part-thickness and the smoothness of the polish become more progressively more difficult to achieve with existing abrading machines and abrading processes. In addition, it is necessary to reduce the processing costs without sacrificing performance. Also, it is highly desirable to eliminate the use of messy liquid abrasive slurries. Changing the abrading process set-up of most of the present abrading systems to accommodate different sized abrasive particles, different abrasive materials or to match abrasive disk features or the size of the abrasive disks to the workpiece sizes is typically tedious and difficult.

Fixed-Spindle-Floating-Platen System

The present invention relates to methods and devices for a single-sided lapping machine that is capable of producing ultra-thin semiconductor wafer workpieces at high abrading speeds. This is done by providing a flat surfaced granite machine base that is used for mounting three individual rigid flat-surfaced rotatable workpiece spindles. Flexible abrasive disks having annular bands of fixed-abrasive coated raised islands are attached to a rigid flat-surfaced rotary platen. The platen annular abrading surface floats in three-point abrading contact with flat surfaced workpieces that are mounted on the three equal-spaced flat-surfaced rotatable workpiece spindles. Water coolant is used with these raised island abrasive disks.

Presently, floating abrasive platens are used in double-sided lapping and double-sided micro-grinding (flat-honing) but the abrading speeds of both of these systems are very low. The upper floating platen used with these systems are positioned in conformal contact with multiple equal-thickness workpieces that are in flat contact with the flat abrading surface of a lower rotary platen. Both the upper and lower abrasive coated platens are typically concentric with each other and they are rotated independent of each other. Often the platens are rotated in opposite directions to minimize the net abrading forces that are applied to the workpieces that are sandwiched between the flat annular abrading surfaces of the two platens.

In order to compensate for the different abrading speeds that exist at the inner and outer radii of the annular band of abrasive that is present on the rotating platens, the workpieces are rotated. The speed of the rotated workpiece reduces the too-fast platen speed at the outer periphery of the platen and increases the too-slow speed at the inner periphery when the platen and the workpiece are both rotated in the same direction. However, if the upper abrasive platen and the lower abrasive platen are rotated in opposite directions, then rotation of the workpieces is favorable to the platen that is rotated in the same direction as the workpiece rotation and is unfavorable for the other platen that rotates in a direction that opposes the workpiece rotation direction. Here, the speed differential provided by the rotated workpiece acts against the abrading speed of the opposed rotation direction platen. Because the localized abrading speed represents the net speed difference between the workpieces and the platen, rotating them in opposite directions increases the localized abrading speeds to where it is too fast. Providing double-sided abrading where the upper and lower platens are rotated in opposed directions results over-speeding of the abrasive on one surface of a workpiece compared to an optimum abrading speed on the opposed workpiece surface.

In double-sided abrading, rotation of the workpieces is typically done with thin gear-driven planetary workholder disks that carry the individual workpieces while they are sandwiched between the two platens. Workpieces comprising semiconductor wafers are very thin so the planetary workholders must be even thinner to allow unimpeded abrading contact with both surfaces of the workpieces. The gear teeth on these thin workholder disks that are used to rotate the disks are very fragile, which prevents fast rotation of the workpieces. The resultant slow-rotation workpieces prevent fast abrading speeds of the abrasive platens. Also, because the workholder disks are fragile, the upper and lower platens are often rotated in opposite directions to minimize the net abrading forces on individual workpieces because a portion of this net workpiece abrading force is applied to the fragile disk-type workholders. It is not practical to abrade very thin workpieces with double-sided platen abrasive systems because the required very thin planetary workholder disks are so fragile.

Multiple workpieces are often abrasive slurry lapped using flat-surfaced single-sided platens that are coated with a layer of loose abrasive particles that are in a liquid mixture. Slurry lapping is very slow, and also, very messy.

The platen slurry abrasive surfaces also wear continually during the workpiece abrading action with the result that the platen abrasive surfaces become non-flat. Non-flat platen abrasive surfaces result in non-flat workpiece surfaces. These platen abrasive surfaces must be periodically reconditioned to provide flat workpieces. Conditioning rings are typically placed in abrading contact with the moving annular abrasive surface to re-establish the planar flatness of the platen annular band of abrasive.

In single-sided slurry lapping, a rigid rotating platen has a coating of abrasive in an annular band on its planar surface. Floating-type spherical-action workholder spindles hold individual workpieces in flat-surfaced abrading contact with the moving platen slurry abrasive with controlled abrading pressure.

The fixed-spindle-floating-platen abrading system has many unique features that allow it to provide flat-lapped precision-flat and smoothly-polished thin workpieces at very high abrading speeds. Here, the top flat surfaces of the individual spindles are aligned in a common plane where the flat surface of each spindle top is co-planar with each other. Each of the three rigid spindles is positioned with approximately equal spacing between them to form a triangle of spindles that provide three-point support of the rotary abrading platen. The rotational-centers of each of the spindles are positioned on the granite so that they are located at the radial center of the annular width of the precision-flat abrading platen surface. Equal-thickness flat-surfaced workpieces are attached to the flat-surfaced tops of each of the spindles. The rigid rotating floating-platen abrasive surface contacts all three rotating workpieces to perform single-sided abrading on the exposed surfaces of the workpieces. The fixed-spindle-floating platen system can be used at high abrading speeds with water cooling to produce precision-flat and mirror-smooth workpieces at very high production rates. There is no abrasive wear of the platen surface because it is protected by the attached flexible abrasive disks. Use of abrasive disks that have annular bands of abrasive coated raised islands prevents the common problem of hydroplaning of workpieces when contacting coolant water-wetted continuous-abrasive coatings. Hydroplaning of workpieces causes non-flat workpiece surfaces.

This fixed-spindle-floating-platen system is particularly suited for flat-lapping large diameter semiconductor wafers. High-value large-sized workpieces such as 12 inch diameter (300 mm) semiconductor wafers can be attached with vacuum or by other means to ultra-precise flat-surfaced air bearing spindles for precision lapping of the wafers. Commercially available abrading machine components can be easily assembled to construct these lapper machines. Ultra-precise 12 inch diameter air bearing spindles can provide flat rotary mounting surfaces for flat wafer workpieces. These spindles typically provide spindle top flatness accuracy of 5 millionths of an inch (0.13 micron) (or less, if desired) during rotation. They are also very stiff for resisting abrading load deflections and can support loads of 900 lbs. A typical air bearing spindle having a stiffness of 4,000,000 lbs/inch is more resistant to deflections from abrading forces than a mechanical spindle having steel roller bearings.

Air bearing workpiece spindles can be replaced or extra units added as needed. These air bearing spindles are preferred because of their precision flatness of the spindle surfaces at all abrading speeds and their friction-free rotation. Commercial 12 inch (300 mm) diameter air bearing spindles that are suitable for high speed flat lapping are available from Nelson Air Corp, Milford, N.H. Air bearing spindles are preferred for high speed flat lapping but suitable rotary flat-surfaced spindles having conventional roller bearings can also be used.

Thick-section granite bases that have the required surface flatness accuracy, structural stiffness and dimensional stability to support these heavy air bearing spindles without distortion are also commercially available from numerous sources. Fluid passageways can be provided within the granite bases to allow the circulation of heat transfer fluids that thermally stabilize the bases. This machine base temperature control system provides long-term dimensional stability of the precision-flat granite bases and isolates them from changes in the ambient temperature changes in a production facility. Floating platens having precision-flat planar annular abrading surfaces can also be fabricated or readily purchased.

The flexible abrasive disks that are attached to the platen annular abrading surfaces typically have annular bands of fixed-abrasive coated rigid raised-island structures. There is insignificant elastic distortion of the individual raised islands through the thickness of the raised island structures or elastic distortion of the complete thickness of the raised island abrasive disks when they are subjected to typical abrading pressures. These abrasive disks must also be precisely uniform in thickness across the full annular abrading surface of the disk. This is necessary to assure that uniform abrading takes place over the full flat surface of the workpieces that are attached onto the top surfaces of each of the three spindles. The term "precisely" as used herein refers to within ±5 wavelengths planarity and within ±0.01 degrees of perpendicular or parallel, and precisely coplanar means within ±0.01 degrees of parallel, thickness or flatness variations of less than 0.0001 inches (3 microns) and with a standard deviation between planes that does not exceed ±20 microns.

During an abrading or lapping procedure, both the workpieces and the abrasive platens are rotated simultaneously. Once a floating platen "assumes" a position as it rests conformably upon workpieces attached to the spindle tops and the platen is supported by the three spindles, the planar abrasive surface of the platen retains this nominal platen alignment even as the floating platen is rotated. The three-point spindles are located with approximately equal spacing between them circumferentially around the platen and their rotational centers are in alignment with the radial centerline of the platen annular abrading surface. A controlled abrading pressure is applied by the abrasive platen to the equal-thickness workpieces that are attached to the three rotary workpiece spindles. Due to the evenly-spaced three-point support of the floating platen, the equal-sized workpieces attached to the spindle tops experience the same shared platen-imposed abrading forces and abrading pressures. Here, precision-flat and smoothly polished semiconductor wafer surfaces can be simultaneously produced at all three spindle stations by the fixed-spindle-floating platen abrading system.

Because the floating-platen and fixed-spindle abrading system is a single-sided process, very thin workpieces such as semiconductor wafers or flat-surfaced solar panels can be attached to the rotatable spindle tops by vacuum or other attachment means. To provide abrading of the opposite side of a workpiece, it is removed from the spindle, flipped over and abraded with the floating platen. This is a simple two-step procedure. Here, the rotating spindles provide a workpiece surface that is precisely co-planar with the opposed workpiece surface.

The spindles and the platens can be rotated at very high speeds, particularly with the use of precision-thickness raised-island abrasive disks. These abrading speeds can exceed 10,000 surface feet per minute (SFPM) or 3,048 surface meters per minute. The abrading pressures used here for flat lapping are very low because of the extraordinary high material removal rates of superabrasives (including diamond or cubic boron nitride (CBN)) when operated at very high abrading speeds. The abrading pressures are often less than 1 pound per square inch (0.07 kilogram per square cm) which is a small fraction of the abrading pressures commonly used in abrading. Flat honing (micro-grinding) uses extremely high abrading pressures which can result in substantial sub-surface damage of high value workpieces. The low abrading pressures used here result in highly desired low subsurface damage. In addition, low abrading pressures result in lapper machines that have considerably less weight and bulk than conventional abrading machines.

Use of a platen vacuum disk attachment system allows quick set-up changes where abrasive disks having different sizes of abrasive particles and different types of abrasive material can be quickly attached to the flat platen annular abrading surfaces. Changing the sized of the abrasive particles on all of the other abrading systems is slow and tedious. Also, the use of messy loose-abrasive slurries is avoided by using the fixed-abrasive disks.

A minimum of three evenly-spaced spindles are used to obtain the three-point support of the upper floating platen by contacting the spaced workpieces. However, additional spindles can be mounted between any two of the three spindles that form three-point support of the floating platen. Here all of the workpieces attached to the spindle-tops are in mutual flat abrading contact with the rotating platen abrasive.

The system has the capability to resist large mechanical abrading forces that can be present with abrading processes while maintaining unprecedented rotatable workpiece spindle tops flatness accuracies and minimum mechanical flatness out-of-planar variations, even at very high abrading speeds. There is no abrasive wear of the flat surfaces of the spindle tops because the workpieces are firmly attached to the spindle tops and there is no motion of the workpieces relative to the spindle tops. Rotary abrading platens are inherently robust, structurally stiff and resistant to deflections and surface flatness distortions when they are subjected to substantial abrading forces. Because the system is comprised of robust components, it has a long production usage lifetime with little maintenance even in the harsh abrading environment present with most abrading processes. Air bearing spindles are not prone to failure or degradation and provide a flexible system that is quickly adapted to different polishing processes. Drip shields can be attached to the air bearing spindles to prevent abrasive debris from contaminating the spindle. All of the precision-flat abrading processes presently in commercial lapping use typically have very slow abrading speeds of about 5 mph (8 kph). By comparison, the high speed flat lapping system operates at or above 100 mph (160 kph). This is a speed difference ratio of 20 to 1. Increasing abrading speeds increase the material removal rates. High abrading speeds result in high workpiece production rates and large cost savings.

Workpieces are often rotated at rotational speeds that are approximately equal to the rotational speeds of the platens to provide approximately equal localized abrading speeds across the full radial width of the platen abrasive when the workpiece spindles are rotated in the same rotation direction as the platens.

Unlike slurry lapping, there is no abrasive wear of raised island abrasive disk platens because only the non-abrasive flexible disk backing surface contacts the platen surface. Here, the abrasive disk is firmly attached to the platen flat annular abrading surface. Also, the precision flatness of the high speed flat lapper abrasive surfaces can be completely re-established by simply and quickly replacing an abrasive disk having a non-flat abrasive surface with another abrasive disk that has a precision-flat abrasive surface.

Vacuum is used to quickly attach flexible abrasive disks, having different sized particles, different abrasive materials and different array patterns and styles of raised islands. Each flexible disk conforms to the precision-flat platen surface provide precision-flat planar abrading surfaces. Quick lapping process set-up changes can be made to process a wide variety of workpieces having different materials and shapes with application-selected raised island abrasive disks that are optimized for them individually. Abrasive disk and floating platens can have a wide range of abrading surface diameters that range from 2 inches (5 cm) to 72 inches (183 cm) or even much greater diameters. Abrasive disks that have non-island continuous coatings of abrasive material can also be used on the fixed-spindle floating-platen abrading system.

Hydroplaning of workpieces occurs when smooth abrasive surfaces, having a continuous thin-coated abrasive, are in fast-moving contact with a flat workpiece surface in the presence of surface water. However, hydroplaning does not occur when interrupted-surfaces, such as abrasive coated raised islands, contact a flat water-wetted workpiece surface. An analogy to the use of raised islands in the presence of coolant water films is the use of tread lugs on auto tires which are used on rain slicked roads. Tires with lugs grip the road at high speeds while bald smooth-surfaced tires hydroplane. In the same way, the abrasive coatings of the flat-surface tops of the raised islands remain in abrading contact with water-wetted flat-surfaced workpieces, even at very high abrading speeds.

A uniform thermal expansion and contraction of air bearing spindles occurs on all of the air bearing spindles mounted on the granite or other material machine bases when each of individual spindles are mounted with the same methods on the bases. The spindles can be mounted on spindle legs attached to the bottom of the spindles or the spindles can be mounted to legs that are attached to the upper portion of the spindle bodies and the length expansion or shrinkage of all of the spindles will be the same. This insures that precision abrading can be achieved with these fixed-spindle floating-platen abrading systems. This invention references commonly assigned U.S. Pat. Nos. 5,910,041; 5,967,882; 5,993,298; 6,048,254; 6,102,777; 6,120,352; 6,149,506; 6,607,157; 6,752,700; 6,769,969; 7,632,434 and 7,520,800, commonly assigned U.S. patent application published numbers 20100003904; 20080299875 and 20050118939 and U.S. patent application Ser. Nos. 12/661,212, 12/799,841 and 12/807,802 and all contents of which are incorporated herein by reference.

U.S. Pat. No. 7,614,939 (Tolles et al) describes a CMP polishing machine that uses flexible pads where a conditioner device is used to maintain the abrading characteristic of the pad. Multiple CMP pad stations are used where each station has different sized abrasive particles. U.S. Pat. No. 4,593,495 (Kawakami et al) describes an abrading apparatus that uses planetary workholders. U.S. Pat. No. 4,918,870 (Torbert et al) describes a CMP wafer polishing apparatus where wafers are attached to wafer carriers using vacuum, wax and surface tension using wafer. U.S. Pat. No. 5,205,082 (Shendon et al) describes a CMP wafer polishing apparatus that uses a floating retainer ring. U.S. Pat. No. 6,506,105 (Kajiwara et al) describes a CMP wafer polishing apparatus that uses a CMP with a separate retaining ring and wafer pressure control to minimize over-polishing of wafer peripheral edges. U.S. Pat. No. 6,371,838 (Holzapfel) describes a CMP wafer polishing apparatus that has multiple wafer heads and pad conditioners where the wafers contact a pad attached to a rotating platen. U.S. Pat. No. 6,398,906 (Kobayashi et al) describes a wafer transfer and wafer polishing apparatus. U.S. Pat. No. 7,357,699 (Togawa et al) describes a wafer holding and polishing apparatus and where excessive rounding and polishing of the peripheral edge of wafers occurs. U.S. Pat. No. 7,276,446 (Robinson et al) describes a web-type fixed-abrasive CMP wafer polishing apparatus.

U.S. Pat. No. 6,786,810 (Muilenberg et al) describes a web-type fixed-abrasive CMP article. U.S. Pat. No. 5,014,486 (Ravipati et al) and U.S. Pat. No. 5,863,306 (Wei et al) describe a web-type fixed-abrasive article having shallowislands of abrasive coated on a web backing using a rotogravure roll to deposit the abrasive islands on the web backing. U.S. Pat. No. 5,314,513 (Milleret al) describes the use of ceria for abrading.

U.S. Pat. No. 6,001,801 (Fujimori et al) describes an abrasive dressing tool that is used for abrading a rotatable CMP polishing pad that is attached to a rigidly mounted lower rotatable platen.

U.S. Pat. No. 6,077,153 (Fujita et al) describes a semiconductor wafer polishing machine where a polishing pad is attached to a rigid platen that rotates. The polishing pad is positioned to contact wafer-type workpieces that are attached to rotary workpiece spindles. These rotary workpiece spindles are mounted on a rigidly-mounted rotary platen. The rotatable abrasive polishing pad platen is rigidly mounted and travels along its rotation axis. However, it does not have a floating-platen action that allows the platen to have a spherical-action motion as it rotates. Because the workpiece spindles are mounted on a rotary platen they are not attached to a stationary machine base such as a granite base. Because of the configuration of the Fujita machine, it can not be used to provide a floating abrasive coated platen that allows the flat surface of the platen abrasive to be in floating conformal abrading contact with multiple workpieces that are attached to rotary workpiece spindles that are mounted on a rigid machine base.

U.S. Pat. No. 6,425,809 (Ichimura et al) describes a semiconductor wafer polishing machine where a polishing pad is attached to a rigid rotary platen. The polishing pad is in abrading contact with flat-surfaced wafer-type workpieces that are attached to rotary workpiece holders. These workpiece holders have a spherical-action universal joint. The universal joint allows the workpieces to conform to the surface of the platen-mounted abrasive polishing pad as the platen rotates. However, the spherical-action device is the workpiece holder and is not the rotary platen that holds the fixed abrasive disk.

U.S. Pat. No. 6,769,969 (Duescher) describes flexible abrasive disks that have annular bands of abrasive coated raised islands. These disks use fixed-abrasive particles for high speed flat lapping as compared with other lapping systems that use loose-abrasive liquid slurries. The flexible raised island abrasive disks are attached to the surface of a rotary platen to abrasively lap the surfaces of workpieces.

Various abrading machines and abrading processes are described in U.S. Pat. Nos. 5,364,655 (Nakamura et al). 5,569,062 (Karlsrud), 5,643,067 (Katsuoka et al), 5,769,697 (Nisho), 5,800,254 (Motley et al), 5,916,009 (Izumi et al), 5,964,651 (hose), 5,975,997 (Minami, 5,989,104 (Kim et al), 6,089,959 (Nagahashi, 6,165,056 (Hayashi et al), 6,168,506 (McJunken), 6,217,433 (Herrman et al), 6,439,965 (Ichino), 6,893,332 (Castor), 6,896,584 (Perlov et al), 6,899,603 (Homma et al), 6,935,013 (Markevitch et al), 7,001,251 (Doan et al), 7,008,303 (White et al), 7,014,535 (Custer et al), 7,029,380 (Horiguchi et al), 7,033,251 (Elledge), 7,044,838 (Maloney et al), 7,125,313 (Zelenski et al), 7,144,304 (Moore), 7,147,541 (Nagayama et al), 7,166,016 (Chen), 7,250,368 (Kida et al), 7,367,867 (Boller), 7,393,790 (Britt et al), 7,422,634 (Powell et al), 7,446,018 (Brogan et al), 7,456,106 (Koyata et al), 7,470,169 (Taniguchi et al), 7,491,342 (Kamiyama et al), 7,507,148 (Kitahashi et al), 7,527,722 (Sharan) and 7,582,221 (Netsu et al).

SUMMARY OF THE INVENTION

The presently disclosed technology includes a fixed-spindle, floating-platen system which is a new configuration of a single-sided lapping machine system. This system is capable of producing ultra-flat thin semiconductor wafer workpieces at high abrading speeds. This can be done by providing a precision-flat, rigid (e.g., synthetic, composite or granite) machine base that is used as the planar mounting surface for at least three rigid flat-surfaced rotatable workpiece spindles. Precision-thickness flexible abrasive disks are attached to a rigid flat-surfaced rotary platen that floats in three-point abrading contact with the three equal-spaced flat-surfaced rotatable workpiece spindles. These abrasive coated raised island disks have disk thickness variations of less than 0.0001 inches (3 microns) across the full annular bands of abrasive-coated raised islands to allow flat-surfaced contact with workpieces at very high abrading speeds and to assure that all of the expensive diamond abrasive particles that are coated on the island are fully utilized during the abrading process. Use of a platen vacuum disk attachment system allows quick set-up changes where different sizes of abrasive particles and different types of abrasive material can be quickly attached to the flat platen surfaces.

Water coolant is used with these raised island abrasive disks, which allows them to be used at very high abrading speeds, often in excess of 10,000 SFPM (160 km per minute). The coolant water is typically applied directly to the top surfaces of the workpieces. The applied coolant water results in abrading debris being continually flushed from the abraded surface of the workpieces. Here, when the water-carried debris falls off the spindle top surfaces it is not carried along by the platen to contaminate and scratch the adjacent high-value workpieces, a process condition that occurs in double-sided abrading and with continuous-coated abrasive disks.

The fixed-spindle floating-platen flat lapping system has two primary planar references. One planar reference is the precision-flat annular abrading surface of the rotatable floating platen. The other planar reference is the precision co-planar alignment of the flat surfaces of the rotary spindle tops of the three workpiece spindles that provide three-point support of the floating platen.

Flat surfaced workpieces are attached to the spindle tops and are contacted by the abrasive coating on the platen abrading surface. Both the workpiece spindles and the abrasive coated platens are simultaneously rotated while the platen abrasive is in controlled abrading pressure contact with the exposed surfaces of the workpieces. Workpieces are sandwiched between the spindle tops and the floating platen. This lapping process is a single-sided workpiece abrading process. The opposite surfaces of the workpieces can be lapped by removing the workpieces from the spindle tops, flipping them over, attaching them to the spindle tops and abrading the second opposed workpiece surfaces with the platen abrasive.

A granite machine base provides a dimensionally stable platform upon which the three (or more) workpiece spindles are mounted. The spindles must be mounted where their spindle tops are precisely co-planar within 0.0001 inches (3 microns) in order to successfully perform high speed flat lapping. The rotary workpiece spindles must provide rotary spindle tops that remain precisely flat at all operating speeds. Also, the spindles must be structurally stiff to avoid deflections in reaction to static or dynamic abrading forces.

Air bearing spindles are the preferred choice over roller bearing spindles for high speed flat lapping. They are extremely stiff, can be operated at very high rotational speeds and are frictionless. Because the air bearing spindles have no friction, torque feedback signal data from the internal or external spindle drive motors can be used to determine the state-of-finish of lapped workpieces. Here, as workpieces become flatter and smoother, the water wetted adhesive bonding stiction between the flat surfaced workpieces and the flat-type abrasive media increase. The relationship between the state-of-finish of the workpieces and the adhesive stiction is a very predictable characteristic and can be readily used to control or terminate the flat lapping process.

Air bearing or mechanical roller bearing workpiece spindles having near-equal spindle heights can be mounted on flat granite bases to provide a system where the flat spindle tops are co-planar with each other. These precision-height spindles and precision flat granite bases are more expensive than commodity type spindles and granite bases. Commodity type air bearing spindles and non-precision flat granite bases can be utilized with the use of adjustable height legs that are attached to the bodies of the spindles.

An alternative method that can be used to attach rotary workpiece spindles to granite bases is to provide spherical-action mounts for each spindle. These spherical mounts allow each spindle top to be aligned to be co-planar with the other attached spindles. Workpiece spindles are attached to the rotor portion of the spherical mount that has a spherical-action rotation within a spherical base that has a matching spherical shaped contacting area. The spherical-action base is attached to the flat surface of a granite machine base. After the spindle tops are precisely aligned to be co-planar with each other, a mechanical or adhesive-based fastener device can be used to fixture or lock the spherical mount rotor to the spherical mount base. Using these spherical-action mounts, the precision aligned workpiece spindles are structurally attached to the granite base. The flat surfaces of the spindle tops can be aligned to be precisely co-planar within the required 0.0001 inches (3 microns) with the use of a rotating laser beam measurement device supplied by Hamar Laser Inc. of Danbury, Conn.

Another very simple technique that can be used for co-planar alignment of the workpiece spindle-tops is to use the precision-flat surface of a floating platen annular abrading surface as a physical planar reference datum for the spindle tops. Platens must have precision flat surfaces where the flatness variation is less than 0.0001 inches (3 microns) in order to successfully perform high speed flat lapping. Here, the precision-flat platen is brought into flat surfaced contact with the spindle-tops where pressurized air or a liquid can be applied through fluid passageways to form a spherical-action fluid bearing that allows the spherical rotor to freely float without friction within the spherical base. This platen surface contacting action aligns the spindle-tops with the flat platen surface. By this platen-to-spindles contacting action, the spindle tops are also aligned to be co-planar with each other.

After co-planar alignment of the spindle tops, vacuum can be applied through the fluid passageways to temporarily lock the spherical rotors to the spherical bases. Then, a mechanical fastener or an adhesive-based fastener device is used to fixture or lock the spherical mount rotor to the spherical mount base. When using an adhesive rotor locking system, an adhesive can be applied in a small gap between a removable bracket that is attached to the spherical rotor and a removable bracket that is attached to the spherical base to rigidly bond the spherical rotor to the spherical base after the adhesive is solidified. If it is desired to re-align the spindle top, the removable spherical mount rotor and spherical base adhesive brackets can be discarded and replaced with new individual brackets that can be adhesively bonded together to again lock the spherical mount rotors to the respective spherical bases.

A preferred technique of aligning the workpiece spindle tops to be precisely co-planar with each other is to use independent laser devices that are attached to a laser arm that is attached to the spindle-top of a rotary alignment spindle that is positioned at a center location relative to the three workpiece rotary spindles. The laser arm has one integral portion that is attached to the alignment spindle-top and another integral portion that extends radially beyond the periphery edge of the alignment spindle-top at least to the outermost portions of the three workpiece rotary spindles that surround the alignment spindle.

At least one but preferably three laser measurement sensors are attached to the laser arm and are positioned along the longitudinal axis of the laser arm at respective positions that allow distance measurements to be made to selected target points on the respective surfaces of the at least three workpiece spindle's rotary spindle-tops.

The spindle-top of the rotary alignment spindle has a very precision operating characteristic in that the dimensional variation of selected points on the spindle top in the plane of the flat exposed surface of the spindle-top as it is rotated through 360 degrees is much less than 0.0001 inches (3 microns) as measured from the plane of the flat exposed surface of the spindle-top.

For typical air bearing spindles used as a rotary alignment spindle, the out-of-plane variations of the spindle-top flat surfaces are less than 5 millionths of an inches during rotation as measured relative to a selected point or selected points that are external to the alignment spindle body. The planar accuracy of the air bearing alignment rotary spindle is more than sufficient to provide co-planar alignment of the workpiece spindle-tops to within the desired 0.0001 inches using the laser measurement devices that are attached to the laser arm. These air bearing spindles are also very stiff in resisting applied force load deflections. The same air bearing rotary spindles that are used for workpieces can also be used as a rotary alignment spindle. Also, specialty small-sized, light-weight, low-profile or non-driven air bearing rotary spindles can be used as rotary alignment spindles.

Precision-flat machine bases are preferred to be constructed from granite, epoxy-granite, composite polymer materials or cast iron materials. The desired machine base surface flatness variation, as measured from the plane of the machine base top surface, is less than 0.001 inches or more preferably less than 0.005 inches or even more preferably less than 0.0001 inches.

A laser arm device can be rigidly attached to the flat surface of the rotary alignment spindle that is positioned at a center location relative to the at least three workpiece rotary spindles. Vacuum, adhesives or mechanical fasteners can be used to attach a laser arm to an alignment spindle.

The laser arm device has a laser arm leg that extends past the periphery of the spindle-top of the rotary alignment spindle and extends radially outward past the outermost periphery portion of all of the spindle-tops of the at least three rotary workpiece spindles. One or more laser or mechanical or ultrasonic or other types of distance measurement sensor devices are attached along the length of the laser arm device where it is preferable that the distance measurement devices are position in a straight line that is aligned with a longitudinal axis of the laser arm device. Mechanical or ultrasonic or other types of distance measurement sensor devices can be used interchangeably with the laser measurement sensors even thought the workpiece spindle co-planar alignment system is described here with laser sensors.

Each laser measurement device can be used to precisely measure the distance between the respective laser measurement device and selected measurement targets or measurement target locations with a distance measurement accuracy capability of making measurements where accuracy variations are less than 0.0001 inches. The selected distance measurement targets can be located on the flat surfaces of the workpiece spindle-tops or they can be located on the flat planar surface of the machine base that the spindles are mounted upon.

These laser sensors can be used to co-planar align the top flat surfaces of all three (or more) of the workpiece spindle tops using sets of laser measurement data from the individual laser sensors. Here, laser measurement distances measured by each individual laser sensor to select targets on the flat surfaces of the workpiece spindle-tops are used to align the top flat surfaces of all of the workpiece spindles to be co-planar with each other.

The laser measurement sensor devices can also be used to align the flat top surface of the alignment spindle to be precisely parallel with a precision-flat workpiece spindle mounting surface of the machine base. Here, the laser measurement sensor devices attached to the laser arm device can be used to align the flat top surface of the alignment spindle to be best-fit parallel aligned with a nominally-flat workpiece spindle mounting surface of the machine base. To accomplish this parallel alignment, the laser arm that is attached to the alignment spindle is rotated to selected locations around the circumference of the machine base and the respective distance measurements are made between the three laser measurement sensors and targets on the top surface on the surface of the machine base.

The alignment spindle is tilt-adjusted until a best-fit co-planar alignment is established between the top planar surface of the alignment spindle and the top planar surface of the machine base. When the top flat surface of the alignment spindle is co-planar aligned with the top flat surface of the machine base, the alignment spindle can be attached to the machine base if the weight of the alignment spindle is not sufficient to hold it in a stable position during the workpiece spindle co-planar alignment procedures.

In another embodiment, the laser arm device can be a dual-arm device where the laser measurement sensor arm extends out radially in two opposed directions from the alignment spindle. Each opposed extended leg of the arm contains at least one but preferably a set of three laser measurement sensors that have the same radial distance location relative to the rotational center of the alignment spindle. Here, the alignment spindle can be rotated where the laser sensors on one extended leg of the laser arm can measure distances to the machine base surface, or to the surfaces of the workpiece spindles, and the spindle can be rotated where the at least one sensors on the opposed leg of the laser arm can also make the same respective measurements. Collectively, these multiple measurements form both legs of the laser arm can be used to co-planar align the workpiece spindle-tops with each other or to co-planar align the top surface of the alignment spindle with the top surface of the machine base.

All of the laser measurement sensors can be calibrated after they are attached to the laser arm to provide distance measurements that are referenced to be co-planar with the mounting attachment base of the laser arm that is attached to the alignment spindle. This sensor distance calibration can be done by placing the laser sensor arm on a precision-flat measurement surface and calibrating each of the laser sensors to determine the respective reference distance to the flat reference surface for each individual laser sensor which equivalently establishes all of the laser sensors to be effectively calibrated with reference to the spindle-attachment mounting base portion of the laser sensor arm.

The laser sensor arm attachment base is attached in flat-surfaced contact to the top flat surface of the alignment spindle. Here, the distance-calibrated individual laser sensors that are attached to the laser sensor arm can be used to align the workpiece spindle-tops to be precisely co-planar with each other and to be parallel to the top flat surface of the alignment spindle.

During the procedure of co-planar alignment of the workpiece spindle-top, one, two or even three independent laser measurement arm devices can be used to align the spindle-tops where an average of all of the measurement readings are used to optimize the spindle-top alignments.

The alignment spindle can also be a spindle device that has mechanical roller bearings. This device may be configured to attach the laser arm to a spindle shaft without the use of a spindle having a flat-surfaced alignment spindle.

DETAILED DESCRIPTION OF THE INVENTION

Figure 1:
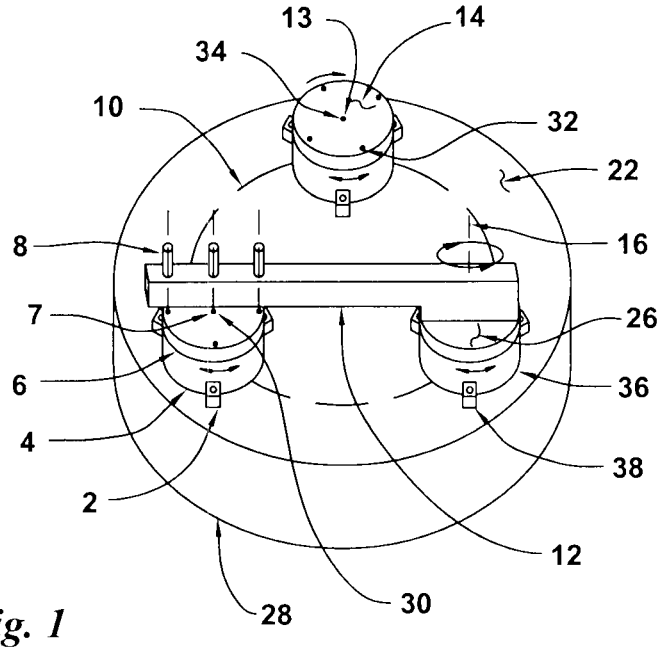
FIG. 1 is an isometric view of an air bearing spindle laser spindle alignment device.

The fixed-spindle floating-platen lapping machines used for high speed flat lapping require very precisely controlled abrading forces that change during a flat lapping procedure. Very low abrading forces are used because of the extraordinarily high cut rates when diamond abrasive particles are used at very high abrading speeds. As per Preston's equation, high abrading pressures result in high material removal rates. The high cut rates are used initially with coarse abrasive particles to develop the flatness of the non-flat workpiece. Then, lower cut rates are used with medium or fine sized abrasive particles during the polishing portion of the flat lapping operation.

When the abrading forces are accurately controlled, the friction that is present in the lapper machine components can create large variations in the abrading forces that are generated by machine members. Here, even though the generated forces are accurate, these forces are either increased or decreased by machine element friction. Abrading forces that are not precisely accurate prevent successful high speed flat lapping. Also, the lapping machines must be robust to resist abrading forces without distortion of the machine members in a way that affects the flatness of the workpieces. Further, the machine must be light in weight, easy to use and tolerant of the harsh abrasive environment.

Pivot-Balance Floating-Platen Machine

The fixed-spindle floating-platen lapping machines used for high speed flat lapping require very precisely controlled abrading forces that change during a flat lapping procedure. Very low abrading forces are used because of the extraordinarily high cut rates when diamond abrasive particles are used at very high abrading speeds. As per Preston's equation, high abrading pressures result in high material removal rates. The high cut rates are used initially with coarse abrasive particles to develop the flatness of the non-flat workpiece. Then, lower cut rates are used with medium or fine sized abrasive particles during the polishing portion of the flat lapping operation.

When the abrading forces are accurately controlled, the friction that is present in the lapper machine components can create large variations in the abrading forces that are generated by machine members. Here, even though the generated forces are accurate, these forces are either increased or decreased by machine element friction. Abrading forces that are not precisely accurate prevent successful high speed flat lapping.

Also, the lapping machines must be robust to resist abrading forces without distortion of the machine members in a way that affects the flatness of the workpieces. Further, the machine must be light in weight, easy to use and tolerant of the harsh abrasive environment The pivot-balance floating-platen lapping machine provides these desirable features.

The lapper machine components such as the platen drive motor are used to counterbalance the weight of the abrasive platen assembly. Low friction pivot bearings are used. The whole pivot frame can be raised or lowered from a machine base by an electric motor driven screw jack. Zero-friction air bearing cylinders can be used to apply the desired abrading forces to the platen as it is held in 3-point abrading contact with the workpieces attached to rotary spindles.

The air pressure applied to the air cylinder is typically provide by a I/P (electrical current-to-pressure) pressure regulator that is activated by an abrading process controller. The actual force generated by the air cylinder can be sensed and verified by an electronic force sensor load cell that is attached to the piston end of the air cylinder. The force sensor allows feed-back type closed-loop control of the abrading pressure that is applied to the workpieces. Abrading pressures on the workpieces can be precisely changed throughout the lapping operation by the lapping process controller.

The spindles are attached to a dimensionally stable granite base. Spherical bearings allow the platen to freely float during the lapping operation. A right-angle gear box has a hollow drive shaft to provide vacuum to attach raised island abrasive disks to the platen. A set of two constant velocity universal joints attached to drive shafts allow the spherical motion of the rotating platen.

When the pivot balance is adjusted where the weight of the drive motor and hardware equals the weight of the platen and its hardware, then the pivot balance frame has a "tared" or "zero" balance condition. To accomplish this, a counterbalance weight can be moved along the pivot balance frame. Also, weighted mechanical screw devices can be easily adjusted to provide a true balance condition. Use of frictionless air bearings at the rotational axis of the pivot frame allows this precision balancing to take place.

Co-Planar Aligned Workpiece Spindles

FIG. 1 is an isometric view of an air bearing spindle mounted laser co-planar spindle top alignment device. Rotary workpiece spindles 4, 36 having rotary spindle-tops 6 are mounted on at the outer periphery of the circular shaped machine base 28. The three workpiece spindles 4, 36 are mounted on the flat surface 22 of the machine base 28 where the rotational axes 16 of the spindle tops 6 that intersects the spindle tops 6 rotation-center target point 30, 34 intersects a spindle-circle 10 where the spindle-circle 10 is coincident with the machine base 28 nominally-flat top surface 22. The workpiece spindles 4, 36 are positioned with near-equal distances between them. A laser sensor arm 12 is attached to the top flat surface 26 of a selected workpiece spindle 36 spindle-top 6 where the rotary spindle-top 6 of this workpiece spindle 36 can be rotated to selected positions.

At least one but preferably three laser distance sensors 8 are shown attached to the laser sensor arm 12 where the laser distance sensors 8 can be used to measure the precise laser span distance between the laser sensor 8 bottom laser sensor end (not shown) and targets 30, 32, 34 located on the flat surfaces 14 of the workpiece spindle-tops 6. One or more of the three laser distance sensors 8 can also be used to measure the precise laser span distances to select targets (not shown) that are located on the flat surface 22 of the machine base 28. The laser sensor arm 12 that is attached to the top flat surface 14 of the selected rotary workpiece spindle 36 spindle-top 6 can be rotated to align the laser distance sensors 8 with the selected measurement targets 30, 32, 34 located on the surfaces 14 of the workpiece spindles 4 spindle-tops 6 and also to be aligned with targets that are located on the flat surface 22 of the machine base 28. The laser sensor arm 12 can be mounted on or attached to the spindle top 6 flat surface 14 with fasteners. The selected targets 30, 32, 34 located on the located on the flat surfaces 14 of the workpiece spindle-tops 6 and the selected targets on the machine base 28 top surface 22 can be target areas or the selected targets can be reflective target devices.

The spindles 4 are preferred to be air bearing workpiece spindles 4 which typically provide spindle top 6 flat surface 14 flatness accuracy of 5 millionths of an inch (0.13 microns) but can have spindle top 6 flat surface 14 flatness accuracies of only 2 millionths of an inch (0.05 microns). These workpiece spindle 4 spindle-top 6 flatness accuracies are more than adequate to co-planar align the other workpiece spindles 4 spindle-tops 6 flat surfaces 14 within the 0.0001 inches (3 microns) required for high speed flat lapping. In addition, the air bearing workpiece spindles 4 used to precisely co-planar align the other two respective workpiece spindle 4 spindle-tops 6 are also very stiff. This spindle 4 stiffness provides sufficient resisting of workpiece spindle-top 6 deflections due to any torsion loads imposed by overhanging the laser sensor arm 12 past the peripheral edge of the workpiece spindle 36 that is used for alignment of the other two respective workpiece spindles 4. This spindle 4, 36 stiffness also prevents deflection of the sensor 8 end of the laser sensor arm 12 during all phases of the procedure for co-planar alignment of all the individual workpiece spindles 4 spindle-tops 6 flat surfaces 14.

Typically, three workpiece spindles 4, 36 are used for a lapper machine but more than three workpiece spindles 4, 36 can be attached to the machine base 28 and be co-planar aligned using this alignment system. The preferred distance sensors 8 are laser sensors but they can also be mechanical distance measurement sensors 8 such as micrometers and also can be ultrasonic distance sensors 8.

The procedure for co-planar alignment of the workpiece spindle's 4 spindle-tops 6 flat surfaces 14 includes attaching the workpiece spindles alignment spindle 36 to the machine base 28 flat surface 22 and attaching the laser sensing arm 12 having the distance sensors 8 to the workpiece alignment spindle 36 rotary spindle top 6 flat surface 14. Then the laser sensing arm 12 is rotated to select target positions 30, 32, 34 that are located at the rotational centers of the rotary workpiece spindles 4 rotary spindle-tops 6. Laser span distance measurements are made between the ends of the laser sensors 8 and the select target positions 30, 32, 34 to adjust the heights of the selected rotary alignment spindle 36 support legs 38 where the plane of the top flat surface 26 of the selected rotary spindle 36 spindle-top 6 is aligned to intersect the selected target positions 30, 34 that are located at the rotational centers of the two rotary workpiece spindles 4 rotary spindle-tops 6. The aligned rotary alignment spindle 36 is then attached to the machine base 28 top surface 22.

Each of the workpiece spindles 4 spindle-tops 6 flat surfaces 14 are then individually aligned to be co-planar aligned with the top flat surface 26 of the rotary spindle-top 6 of the selected alignment spindle 36 by adjusting the height of the two respective workpiece spindle 4 support legs 2. The co-planar alignment of the workpiece spindles 4 spindle-tops 6 flat surfaces 14 is done by making distance measurements from the ends of the laser sensors 8 to selected targets 30, 32, 34 on the flat surfaces 14 of the workpiece spindles 4 spindle-tops 6. The laser sensing arm 12 is rotated to align the laser sensors 8 with the selected targets 30, 32, 34 on the flat surfaces 14 of the workpiece spindles 4 spindle-tops 6 by manually rotating the rotary spindle-top 6 of the selected alignment spindle 36. When all of the individual workpiece spindles 4 spindle-tops 6 flat surfaces 14 are individually aligned to be co-planar aligned with the with the top flat surface 26 of the selected rotary spindle-top 36, the co-planar aligned rotary workpiece spindles 6 are then attached to the machine base 28 top surface 22.

This co-planar alignment of the workpiece spindle's 4 spindle-tops 6 flat surfaces 14 can be done periodically to re-establish or verify the accuracy of the workpiece spindles 4 co-planar alignment. To verify the accuracy of the co-planar alignment of the three, or more, workpiece spindles' 4 spindle-tops 6, or to improve the accuracy of the co-planar alignment of the three, or more, workpiece spindles' 4 spindle-tops 6, the co-planar alignment procedure can be repeated by selecting a different workpiece spindle 4 to be the workpiece alignment spindle 36 to which the laser sensing arm 12 having the distance sensors 8 is attached.

The three workpiece spindles 4 are mounted on the flat surface 22 of the machine base 28 where the rotational axis 16 of the spindle tops 6 intersects a spindle-circle 10 where the spindle-circle 10 is coincident with the machine base 28 nominally-flat top surface 22. For definitional purposes, a "spindle circle" 10 is a geometric description of a circular path line that is positioned on the flat surface 22 of the machine base 28. Because it is a circle, all of the spindle's axes of rotation 16 intersect that spindle circle 10 and therefore the spindle-tops 6 are all radially centered equidistant from each other. The end result is that workpieces (not shown) that are attached to the spindle-tops 6 are all aligned where they are contacted by the annular band of abrasive (not shown) that is on the rotary platen (not shown) because the platen is also aligned to be concentric with the spindle circle. The spindle circle is a geometric shape just like a triangle or a plane, not a physical entity.

Here, when a laser arm 12 that is attached to the selected rotatable alignment spindle 36 is rotated and a selected laser 8 can be rotated from one workpiece spindle 4 to another where that laser 8 beam will contact similar-location targets 30, 32, 34 on the flat surfaces 14 of the two workpiece spindles 4 spindle-tops 6. By doing this procedure, the flat surfaces 14 of each workpiece spindle 4 first can be adjustment-aligned to be parallel with the spindle-top 6 flat surface 26 of the selected alignment spindle 36 in a direction along the circumference of the spindle circle 10. Next, the flat surfaces 14 of each workpiece spindle 4 can be adjustment-aligned to be parallel with the spindle-top 6 of the selected alignment spindle 36 in a direction along longitudinal lines that extend from the rotational centers 30 of the two workpiece spindles 4 to the position where the rotational axes 16 of the spindle top 6 that the laser arm 12 is attached to. When these alignment adjustments have been made, the flat surfaces 14 of the two workpiece spindles 4 are parallel to the spindle-top 6 flat surface 26 of the selected alignment spindle 36, and the workpiece spindles' 4, 36 spindle-tops 6 surfaces 14 are aligned to be co-planar with each other. In addition, the nominal elevation of the two workpiece spindles' 4 spindle-tops 6 surfaces 14 can be adjusted to assure that the two spindles, 4 spindle tops 6 are co-planar aligned with the top flat surface 26 of the rotary spindle-top 6 of the selected alignment spindle 36 by adjusting the height of the workpiece spindle 4 support legs 2.

Another alignment option is to co-planar align the flat surface 26 of the selected workpiece spindle 36 spindle-top 6 with the flat top surface 22 of the machine base 28 prior to co-planar aligning the flat surface 26 of the selected workpiece spindle 36 spindle-top 6 with the center of rotation points 7, 13 that are located at the target points 30, 34 on the flat surface 26 of the selected workpiece spindle 4 spindle-top 6.

Figure 2:
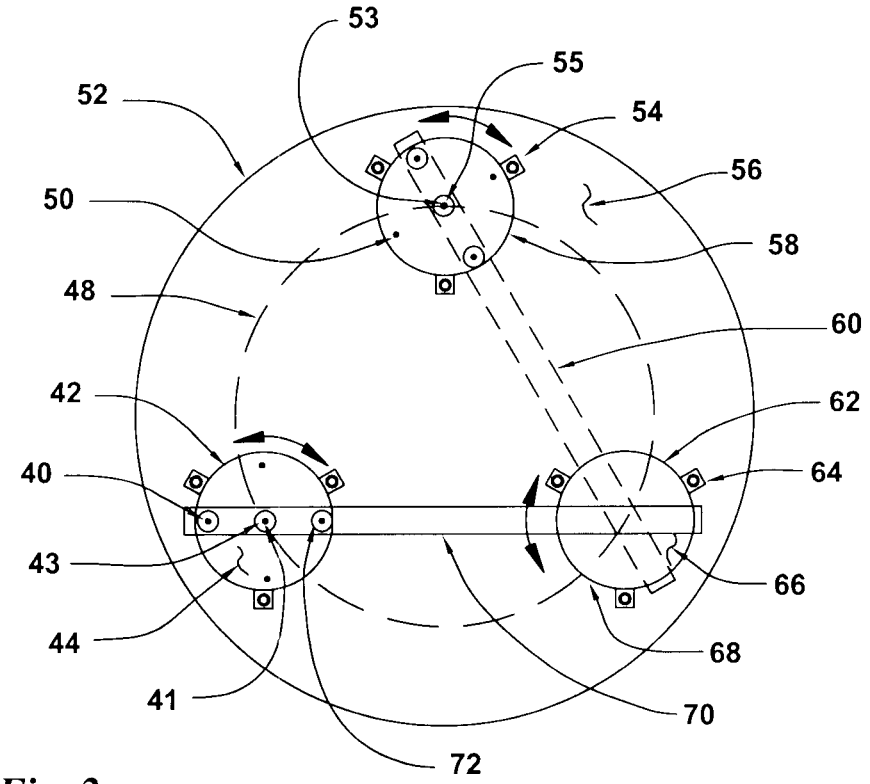
FIG. 2 is a top view of an air bearing spindle laser co-planar spindle top alignment device

FIG. 2 is a top view of an air bearing spindle mounted laser co-planar spindle top alignment device. An air bearing rotary alignment spindle 62 is selected from one of at least three air bearing workpiece spindles 58 that are mounted on the flat surface 56 of a granite lapper machine base 52. Rotary workpiece spindles 58, 62 having spindle-tops 42, 68 that have flat surfaces 44, 66 are located at the outer periphery of the circular shaped machine base 52 where these workpiece spindles 58, 62 are positioned with near-equal distances between them. A laser sensor arm 70 is mounted on or attached to the flat surface 66 of the selected rotary alignment spindle 62 spindle-top 68 where the rotary spindle-top 68 of the selected alignment spindle 62 can be rotated to selected positions.

At least one, but preferably three, laser distance sensors 72 are shown attached to the laser sensor arm 70 where the laser distance sensors 72 having respective laser beam axes 40 can be used to measure the precise laser span distance between the laser sensor 72 bottom laser sensor end (not shown) and targets 43, 50, 53 located on the flat surfaces 44 of the two workpiece spindle's 58 spindle-tops 42. One or more of the three laser distance sensors 72 can also be used to measure the precise laser span distances to select targets (not shown) that are located on the flat surface 56 of the machine base 52.

The laser sensor arm 70 is shown also in an alternative rotated measurement location as laser sensor arm 60 where the laser distance sensors 72 can be used to measure the precise laser span distance between the laser sensor 72 bottom laser sensor end and multiple targets 50 located on the flat surface 44 of the second workpiece spindle's 58 spindle-top 42. Each of the workpiece spindles 58, 62 have height adjustable support legs 54, 64. These legs 54, 64 can be adjusted in height to align the flat surfaces 44 of the two workpiece spindle-tops 42 to be co-planar with the selected alignment workpiece spindle 62 spindle-top 68 flat surface 66.

In particular, the selected alignment spindle 62 has height adjustable support legs 64 that are individually adjusted in height to align the flat top surface 66 of the selected alignment workpiece spindle 62 spindle-top 68 to be co-planar with the targets 43, 53 that are located at the rotational centers 41, 55 of the two workpiece spindles 58.

In another embodiment, all of the workpiece spindles 58, 62 can be mounted on spherical-action mounts (not shown) that are attached to the flat top surface 56 of the machine base 52. The alignment workpiece spindle 62 and the other two workpiece spindles 58 can be rotated about respective spherical-action mounts' spherical rotational centers to co-planar align the spindle-tops 42, 68 flat surfaces 44, 66 with each other. The centers of rotation of the workpiece spindles' 58, 62 spherical-action mounts are located at the respective selected target positions 43, 53.

In a further embodiment, laser span distance measurements are made between the ends of the laser sensors 72 and the select respective spindle-top 42 rotation center target positions 43, 53 to adjust the heights of the selected rotary alignment spindle 62 support legs 64 where the plane of the top flat surface 66 of the selected rotary alignment spindle 62 spindle-top 68 is aligned to intersect the respective selected target positions 43, 53 that are located at the rotational centers 41, 55 of the workpiece spindles 58. The elevation of the select respective spindle-top 42 target positions 43, 53 located at the rotation centers 41, 55 tend not change relative to the surface 56 of the machine base 52 when the respective workpiece spindles 58 that are mounted on the spherical-action mounts are tilted about the spherical-action mounts spherical rotation centers that are located respectively at the select respective spindle-top 42 rotation center target positions 43, 53 to co-planar align the spindle-tops 42, 68. The selected aligned rotary alignment spindle 62 is then attached to the machine base 52 top surface 56.

The co-planar alignment procedure is continued to co-planar align the top flat surfaces 44 of the workpiece spindles 58 spindle-tops 42 with the top flat surface 66 of the selected rotary alignment spindle 62 spindle-top 68 by tilting the workpiece spindles 58 about spherical centers of rotation located at the respective spindle-top 42 rotation center target positions 43, 53. The workpiece spindles 58 can be tilted about spherical centers of rotation located at the respective spindle-top 42 rotation center target positions 43, 53 by tilting the workpiece spindles 58 spherical-action mounts.

In yet another embodiment of the co-planar alignment of the spindle-top 42, 68 flat surfaces 44, 66, a laser sensor arm 70 is mounted on or attached to the flat surface 66 of the selected rotary alignment spindle 62 spindle-top 68 where the rotary spindle-top 68 of the selected alignment spindle 62 can be rotated to selected positions. Then the rotary spindle-top 68 of the selected alignment spindle 62 can be aligned to be parallel to the surface 56 of the machine base 52. Also, the rotary spindle-top 68 of the selected alignment spindle 62 can be aligned to be parallel to the targets 43, 53 that are located at the rotational centers 41, 55 of the workpiece spindles 58 after which the selected alignment spindle 62 can be temporarily fixtured in that aligned position. Following this, the other two flat surfaces 44 of the workpiece spindle-tops 42 are aligned to be co-planar with the selected alignment workpiece spindle 62 spindle-top 68 flat surface 66. Upon completion of the co-planar alignment of all three flat surfaces 44, 66 of the three spindles' 58, 62, the complete co-planar spindle-top 42, 68 co-planar alignment procedure can be repeated once or multiple times using the same selected alignment workpiece spindle 62 or a different workpiece spindle 58 can be selected for attachment of the laser sensor arm 70 having the laser distance sensors 72. This spindle 58, 62 co-planar alignment procedure can be repeated until the out-of-plane-variations are less than the desired 0.0001 inches (3 microns).

In a further embodiment of the co-planar alignment of the spindle-top 42, 68 flat surfaces 44, 66, a laser sensor arm 70 is mounted on or attached to the flat surface 66 of the selected rotary alignment spindle 62 spindle-top 68 where the rotary spindle-top 68 of the selected alignment spindle 62 can be rotated to selected positions. Then, the rotary spindle-top 68 of the selected alignment spindle 62 can be aligned to be parallel to the targets 43, 53 that are located at the rotational centers 41, 55 of the workpiece spindles 58 after which the selected alignment spindle 62 can be temporarily fixtured in that aligned position. Following this, the other two flat surfaces 44 of the workpiece spindle-tops 42 are aligned to be parallel with the selected alignment workpiece spindle 62 spindle-top 68 flat surface 66. Upon completion of the initial parallel alignment of all three flat surfaces 44, 66 of the three spindles' 58, 62, the spindle-top 42, 68 parallel alignment procedure can be repeated using the same selected alignment workpiece spindle 62. As an alternative alignment procedure, a different workpiece spindle 58 can also be selected for attachment of the laser sensor arm 70 having the laser distance sensors 72.

This spindle 58, 62 co-planar alignment procedure that parallel-aligns the selected alignment workpiece spindle 62 spindle-top 68 flat surface 66 with the targets 43, 53 that are located at the rotational centers 41, 55 of the other two flat surfaces 44 of the workpiece spindle-tops 4 with workpiece spindles 58 can be repeated to re-set the alignment position of the selected alignment workpiece spindle 62 spindle-top 68 flat surface 66 with the targets 43, 53 that are located at the rotational centers 41, 55 of the other two flat surfaces 44 of the workpiece spindle-tops 4. Following this, the other two flat surfaces 44 of the workpiece spindle-tops 42 are aligned to be co-planar with the selected alignment workpiece spindle 62 spindle-top 68 flat surface 66. The whole alignment procedure described here can be repeated multiple times to progressively improve the accuracy of the co-planar alignment of all three the spindle-tops 42, 68 with each other.

Fixed-Spindles Floating-Platen

Figure 3:
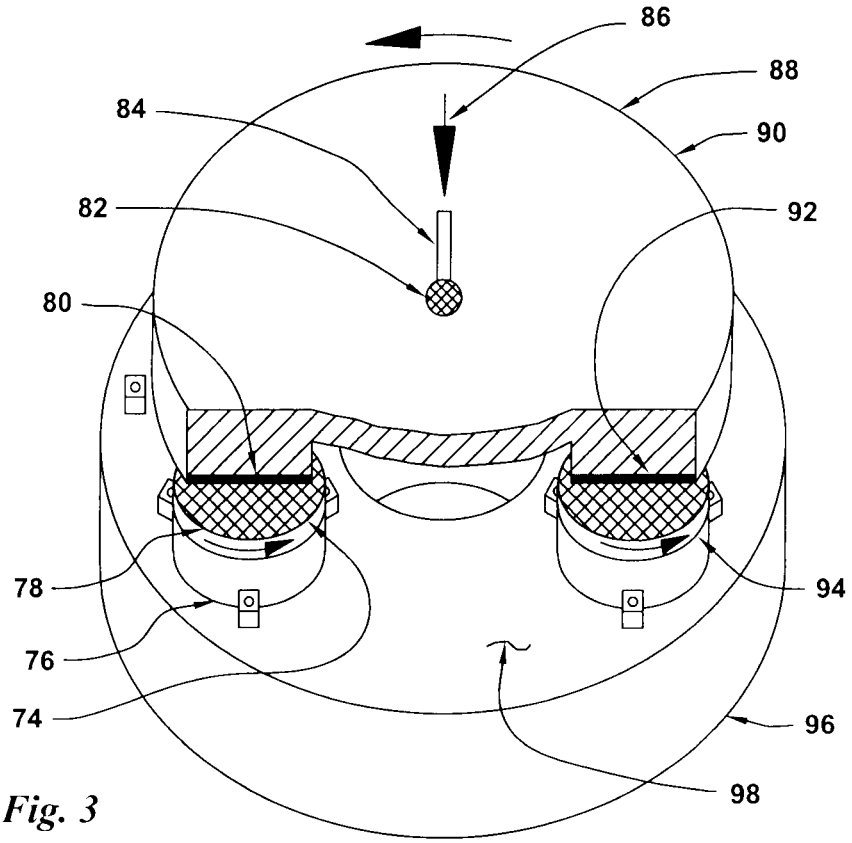
FIG. 3 is an isometric view of an abrading system having fixed-position spindles.

FIG. 3 is an isometric view of an abrading system having three-point fixed-position rotating workpiece spindles supporting a floating rotating abrasive platen. Three evenly-spaced rotatable spindles 76 (one not shown) having rotating tops 94 that have attached workpieces 78 support a floating abrasive platen 88. The platen 88 has a vacuum, or other, abrasive disk attachment device (not shown) that is used to attach an annular abrasive disk 92 to the precision-flat platen 88 abrasive-disk mounting surface 80. The abrasive disk 92 is in flat abrasive surface contact with all three of the workpieces 78. The rotating floating platen 88 is driven through a spherical-action universal-joint type of device 82 having a platen drive shaft 84 to which is applied an abrasive contact force 86 to control the abrading pressure applied to the workpieces 78. The workpiece rotary spindles 76 are mounted on a granite, or other material, base 96 that has a flat surface 98. The three workpiece spindles 76 have spindle top surfaces that are co-planar. The workpiece spindles 76 can be interchanged or a new workpiece spindle 76 can be changed with an existing spindle 76 where the flat top surfaces of the spindles 76 are co-planar. Here, the equal-thickness workpieces 78 are in the same plane and are abraded uniformly across each individual workpiece 78 surface by the platen 88 precision-flat planar abrasive disk 92 abrading surface. The planar abrading surface 80 of the floating platen 88 is approximately co-planar with the flat surface 98 of the granite base 96.

The spindle 76 rotating surfaces spindle tops 94 can driven by different techniques comprising spindle 76 internal spindle shafts (not shown), external spindle 76 flexible drive belts (not shown) and spindle 76 internal drive motors (not shown). The individual spindle 76 spindle tops 94 can be driven independently in both rotation directions and at a wide range of rotation speeds including very high speeds of 10,000 surface feet per minute (3,048 meters per minute). Typically the spindles 76 are air bearing spindles that are very stiff to maintain high rigidity against abrading forces and they have very low friction and can operate at very high rotational speeds. Suitable roller bearing spindles can also be used in place of air bearing spindles.

Abrasive disks (not shown) can be attached to the spindle 76 spindle tops 94 to abrade the platen 88 annular flat surface 80 by rotating the spindle tops 94 while the platen 88 flat surface 80 is positioned in abrading contact with the spindle abrasive disks that are rotated in selected directions and at selected rotational speeds when the platen 88 is rotated at selected speeds and selected rotation direction when applying a controlled abrading force 86. The top surfaces 74 of the individual three-point spindle 76 rotating spindle tops 94 can be also be abraded by the platen 88 planar abrasive disk 92 by placing the platen 88 and the abrasive disk 92 in flat conformal contact with the top surfaces 74 of the workpiece spindles 76 as both the platen 88 and the spindle tops 94 are rotated in selected directions when an abrading pressure force 86 is applied. The top surfaces 74 of the spindles 76 abraded by the platen 88 results in all of the spindle 76 top surfaces 74 being in a common plane.

The granite base 96 is known to provide a time-stable precision-flat surface 98 to which the precision-flat three-point spindles 76 can be mounted. One unique capability provided by this abrading system 90 is that the primary datum-reference can be the fixed-position granite base 96 flat surface 98. Here, spindles 76 can all have the precisely equal heights where they are mounted on a precision-flat surface 98 of a granite base 96 where the flat surfaces 74 of the spindle tops 94 are co-planar with each other.

When the abrading system is initially assembled it can provide extremely flat abrading workpiece 78 spindle 76 top 94 mounting surfaces and extremely flat platen 88 abrading surfaces 80. The extreme flatness accuracy of the abrading system 90 provides the capability of abrading ultra-thin and large-diameter and high-value workpieces 78, such as semiconductor wafers, at very high abrading speeds with a fully automated workpiece 78 robotic device (not shown).

In addition, the system 90 can provide unprecedented system 90 component flatness and workpiece abrading accuracy by using the system 90 components to "abrasively dress" other of these same-machine system 90 critical components such as the spindle tops 94 and the platen 88 planar-surface 80. These spindle top 94 and the platen 88 annular planar surface 80 component dressing actions can be alternatively repeated on each other to progressively bring the system 90 critical components comprising the spindle tops 94 and the platen 88 planar-surface 80 into a higher state of operational flatness perfection than existed when the system 90 was initially assembled. This system 90 self-dressing process is simple, easy to do and can be done as often as desired to reestablish the precision flatness of the system 90 component or to improve their flatness for specific abrading operations.

This single-sided abrading system 90 self-enhancement surface-flattening process is unique among conventional floating-platen abrasive systems. Other abrading systems use floating platens but these systems are typically double-sided abrading systems. These other systems comprise slurry lapping and micro-grinding (flat-honing) systems that have rigid bearing-supported rotated lower abrasive coated platens. They also have equal-thickness flat-surfaced workpieces in flat contact with the annular abrasive surfaces of the lower platens. The floating upper platen annular abrasive surface is in abrading contact with these multiple workpieces where these multiple workpieces support the upper floating platen as it is rotated. The result is that the floating platens of these other floating platen systems are supported by a single-item moving-reference device, the rotating lower platen.

Large diameter rotating lower platens that are typically used for double-sided slurry lapping and micro-grinding (flat-honing) often have substantial abrasive-surface out-of-plane variations. These undesired abrading surface variations are due to many causes comprising: relatively compliant (non-stiff) platen support bearings that transmit or magnify bearing dimension variations to the outboard tangential abrading surfaces of the lower platen abrasive surface; radial and tangential out-of-plane variations in the large platen surface; time-dependent platen material creep distortions; abrading machine operating-temperature variations that result in expansion or shrinkage distortion of the lower platen surface; and the constant wear-down of the lower platen abrading surface by abrading contact with the workpieces that are in moving abrading contact with the lower platen abrasive surface. The single-sided abrading system 90 is completely different than the double-sided system (not-shown).

The floating platen 88 system 90 performance is based on supporting a floating abrasive platen 88 on the top surfaces 74 of three-point spaced fixed-position rotary workpiece spindles 76 that are mounted on a stable machine base 96 flat surface 98 where the top surfaces 74 of the spindles 76 are precisely located in a common plane. The top surfaces 74 of the spindles 76 can be approximately or substantially co-planar with the precision-flat surface 98 of a rigid fixed-position granite, or other material, base 96 or the top surfaces 74 of the spindles 76 can be precisely co-planar with the precision-flat surface 98 of a rigid fixed-position granite, or other material, base 96. The three-point support is required to provide a stable support for the floating platen 88 as rigid components, in general, only contact each other at three points. As an option, additional spindles 76 can be added to the system 90 by attaching them to the granite base 96 at locations between the original three spindles 76.

This three-point workpiece spindle abrading system 90 can also be used for abrasive slurry lapping (not shown), for micro-grinding (flat-honing) (not shown) and also for chemical mechanical planarization (CMP) (not shown) abrading to provide ultra-flat abraded workpieces 78.

Figure 4:
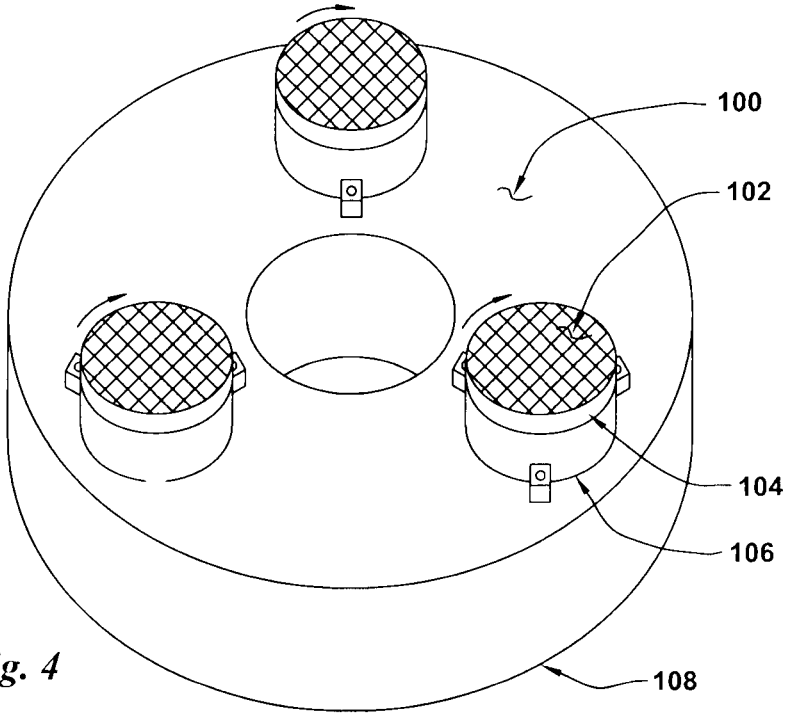
FIG. 4 is an isometric view of fixed-position spindles mounted on a granite base.

FIG. 4 is an isometric view of three-point fixed-position spindles mounted on a granite base. A granite base 108 has a precision-flat top surface 100 that supports three attached workpiece spindles 106 that have rotatable driven tops 104 where flat-surfaced workpieces 102 are attached to the flat-surfaced spindle tops 104.

Raised Elevation Frame and Pivot Frames

The frame of the pivot-balance lapper is attached to a pair of linear slides where the frame can be raised with the use of a pair of electric jacks such as linear actuators. These actuators can provide closed-loop precision control of the position of the pivot frame and are well suited for long term use in a harsh abrading environment. When the pivot frame and floating platen are raised, workpieces can be changed and the abrasive disks that are attached to the platen can be easily changed. The platen is allowed to float with the use of a spherical-action platen shaft bearing.

Single or multiple friction-free air bearing air cylinders can be used to precisely control the abrading forces that are applied to the workpieces by the platen. These air cylinders are located at one end of the beam-balance pivot frame and the platen is located at the opposed end of the beam-balance pivot frame. Use of air bearings on the pivot frame pivot axis shaft eliminates any bearing friction. Cylindrical air bearings that are used on the pivot axis are available from New Way Air Bearing Company, Aston, Pa.

Any force that is applied by the air cylinders is directly transmitted across the length of the pivot frame to the platen because of the lack of pivot bearing friction. Other bearings such as needle bearings, roller bearings or fluid lubricated journal bearings can be used but all of these have more rotational friction than the air bearings. Air bearing cylinders such as the AirPel® cylinders from Airpot Corporation of Norwalk, Conn. can be selected where the cylinder diameter can provide the desired range of abrading forces.

Once the frictionless pivot frame is balanced, any force applied by the abrading force cylinders on one end of the pivot frame is directly transmitted to the platen abrasive surface that is located at the other end of this balance-beam apparatus. To provide a wide range of abrading forces, multiple air cylinders of different diameter sizes can be used in parallel with each other. Because the range of air pressure supplied to the cylinders has a typical limited range of from 0 to 100 psia with limited allowable incremental pressure control changes, it is difficult to provide the extra-precise abrading force load changes required for high speed flat lapping. Use of small-diameter cylinders provide very finely adjusted abrading forces because these small cylinders have nominal force capabilities.

The exact forces that are generated by the air cylinders can be very accurately determined with load cell force sensors. The output of these load cells can be used by feedback controller devices to dynamically adjust the abrading forces on the platen abrasive throughout the lapping procedure. This abrading force control system can even be programmed to automatically change the applied-force cylinder forces to compensate for the very small weight loss experienced by an abrasive disk during a specific lapping operation. Also, the weight variation of "new" abrasive disks that are attached to a platen to provide different sized abrasive particles can be predetermined. Then the abrading force control system can be used to compensate for this abrasive disk weight change from the previous abrasive disk and provide the exact desired abrading force on the platen abrasive.

The abrading force feedback controller provides an electrical current input to an air pressure regulator referred to as an I/P (current to pressure) controller. The abrading force controller has the capability to change the pressures that are independently supplied to each of the parallel abrading force air cylinders. The actual force produced by each independently controlled air cylinder is determined by a respected force sensor load cell to close the feedback loop.

Figure 5:
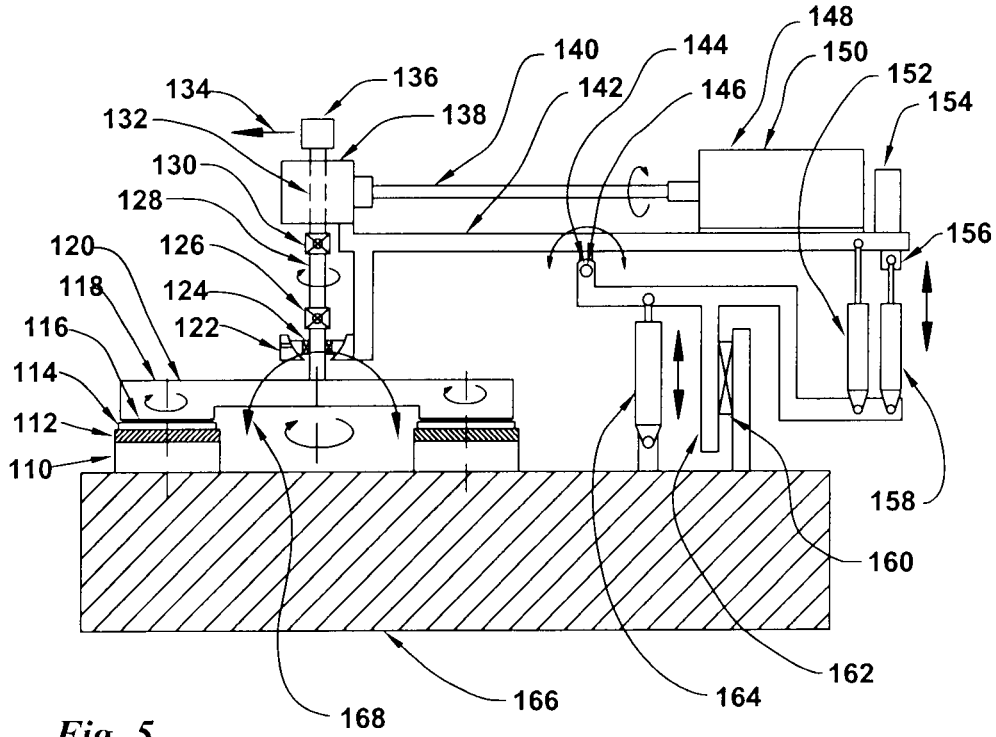
FIG. 5 is a cross section view of a pivot-balance floating-platen lapper machine.

FIG. 5 is a cross section view of a pivot-balance floating-platen lapper machine. The pivot-balance floating-platen lapping machine 148 provides these desirable features. The lapper machine 148 components such as the platen drive motor 150 and a counterweight 154 are used to counterbalance the weight of the abrasive platen assembly 120 where the pivot frame 142 is balanced about the pivot frame 142 pivot center 144. A right-angle gear box 138 has a hollow drive shaft to provide vacuum to attach raised island abrasive disks 116 to the platen 118. The spherical bearing 124 having a spherical rotation 168 can be a roller bearing or an air bearing having an air passage 122 that allows pressurized air to be applied to create an air bearing effect or vacuum to be applied to lock the spherical bearing 124 rotor and housing components together. One or more conventional universal joints or plate-type universal joints or constant velocity universal joints or a set of two constant velocity universal joints 126, 130 attached to the drive shaft 128 allow the spherical rotation and cylindrical rotation motion of the rotating platen 118.

The pivot frame 142 has a rotation axis centered at the pivot frame pivot center 144 where the platen assembly 120 is attached at one end of the pivot frame 142 from the pivot center 144 and the platen motor 150 and a counterbalance weight 154 are attached to the pivot frame 142 at the opposed end of the pivot frame 142 from the pivot center 144. The pivot frame 142 has low friction rotary pivot bearings 146 at the pivot center 144 where the pivot bearings 146 can be frictionless air bearings or low friction roller bearings. The platen drive motor 150 is attached to the pivot frame 142 in a position where the weight of the platen drive motor 150 nominally or partially counterbalances the weight of the abrasive platen assembly 120. A movable and weight-adjustable counterweight 154 is attached to the pivot frame 142 in a position where the weight of the counterweight 154 partially counterbalances the weight of the abrasive platen assembly 120.

The weight of the counterweight 154 is used together with the weight of the platen motor 150 to effectively counterbalance the weight of the abrasive platen assembly 120 that is also attached to the pivot frame 142. When the pivot frame 142 is counterbalanced, the pivot frame 142 pivots freely about the pivot center 144. The platen drive motor 150 rotates a drive shaft 140 that is coupled to the gear box 138 to rotate the gear box 138 hollow drive shaft 132. Vacuum 134 is applied to a rotary union 136 that allows rotation of the gear box 138 drive hollow shaft 132 to route vacuum to the platen 118 through tubing or other passageway devices (not shown) where abrasive disks 116 can be attached to the platen 118 by vacuum. The pivot frame 142 can be rotated to desired positions and locked at the desired rotation position by use of a pivot frame locking device 152 that is attached to the pivot frame 142 and to the pivot frame 142 elevation frame 162. Zero-friction air bearing cylinders 158 can be used to apply the desired abrading forces to the platen 118 as it is held in 3-point abrading contact with the workpieces 114 attached to rotary spindles 110 having rotary spindle-tops 112. The zero-friction air bearing cylinders 158 can be used to apply the desired abrading forces to a force load cell 156 that measures the force applied by the air cylinders 158.

The whole pivot frame 142 can be raised or lowered from a machine base 166 by a elevation frame 162 lift device 164 that can be an electric motor driven screw jack lift device or a hydraulic lift device. The elevation frame 162 lift device 164 is attached to a linear slide 160 that is attached to the machine base 166 and also is attached to the elevation lift frame 162 where the elevation lift frame 162 lift device 164 can have a position sensor (not shown) that can be used to precisely control the vertical position of the elevation frame 162. Zero-friction air bearing cylinders 158 can be used to apply the desired abrading forces to the platen 118 as it is held in 3-point abrading contact with the workpieces 114 attached to rotary spindles 110 having rotary spindle-tops 112. One end of one or more air bearing cylinders 158 can be attached to the pivot frame 142 at different positions to apply forces to the pivot frame 142 where these applied forces provide an abrading force to the platen 118. The support end of the air bearing cylinders can be attached to the elevation frame 162.

Figure 6:
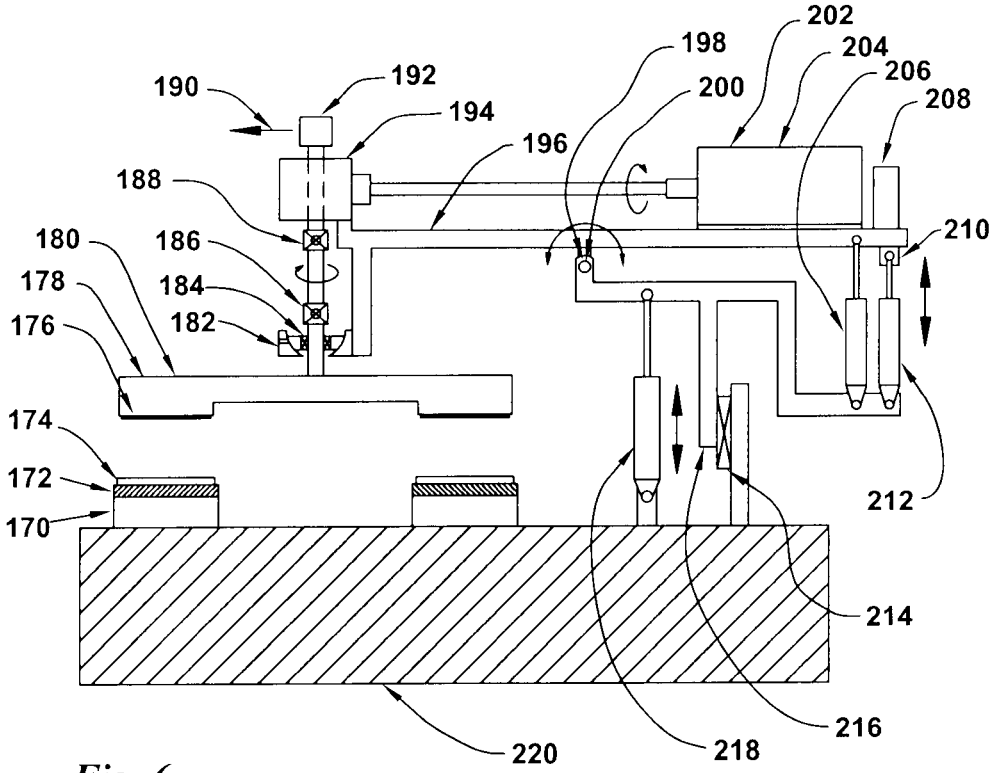
FIG. 6 is a cross section view of a raised pivot-balance floating-platen lapper machine.

FIG. 6 is a cross section view of a raised pivot-balance floating-platen lapper machine. Here, the pivot frame is raised up to allow workpieces and abrasive disks to be changed. The pivot-balance floating-platen lapping machine 202 provides these desirable features. The lapper machine 202 components such as the platen drive motor 204 and a counterweight 208 are used to counterbalance the weight of the abrasive platen assembly 180 where the pivot frame 196 is balanced about the pivot frame 196 pivot center 198.

The pivot frame 196 has a rotation axis centered at the pivot frame pivot center 198 where the platen assembly 180 is attached at one end of the pivot frame 196 from the pivot center 198 and the platen motor 204 and a counterbalance weight 208 are attached to the pivot frame 196 at the opposed end of the pivot frame 196 from the pivot center 198. The pivot frame 196 has low friction rotary pivot bearings 200 at the pivot center 198 where the pivot bearings 200 can be frictionless air bearings or low friction roller bearings. The platen drive motor 204 is attached to the pivot frame 196 in a position where the weight of the platen drive motor 204 nominally or partially counterbalances the weight of the abrasive platen assembly 180. A movable and weight-adjustable counterweight 208 is attached to the pivot frame 196 in a position where the weight of the counterweight 208 partially counterbalances the weight of the abrasive platen assembly 180. The weight of the counterweight 208 is used together with the weight of the platen motor 204 to effectively counterbalance the weight of the abrasive platen assembly 180 that is also attached to the pivot frame 196. When the pivot frame 196 is counterbalanced, the pivot frame 196 pivots freely about the pivot center 198. The platen drive motor 204 rotates a drive shaft 140 that is coupled to the gear box 194 to rotate the gear box 194 hollow drive shaft.

The whole pivot frame 196 can be raised or lowered from a machine base 220 by a elevation frame 216 lift device 218 that can be an electric motor driven screw jack lift device or a hydraulic lift device. The elevation frame 216 lift device 218 can have a position sensor that can be used to precisely control the vertical position of the elevation frame 216. Zero-friction air bearing cylinders 212 can be used to apply the desired abrading forces to the platen 178 as it is held in 3-point abrading contact with the workpieces 174 attached to rotary spindles 170 having rotary spindle-tops 172. One end of one or more air bearing cylinders 212 can be attached to the pivot frame 196 at different positions to apply forces to the pivot frame 196 where these applied forces provide an abrading force to the platen 178. The support end of the air bearing cylinders 212 can also be attached to the elevation frame 216. The floating platen 178 has a spherical rotation and a cylindrical that is provided by the spherical-action platen support bearing 184 that supports the weight of the floating platen 178 where the spherical-action platen support bearing 184 is supported by the pivot frame 196.

The air pressure applied to the air cylinder 212 is typically provide by an I/P (electrical current-to-pressure) pressure regulator (not shown) that is activated by an abrading process controller (not shown). The actual force generated by the air cylinder 212 can be sensed and verified by an electronic force sensor load cell 210 that is attached to the cylinder rod end of the air cylinder 212. The force sensor 210 allows feed-back type closed-loop control of the abrading pressure that is applied to the workpieces 174. Abrading pressures on the workpieces 174 can be precisely changed throughout the lapping operation by the lapping process controller.

The spindles 170 are attached to a dimensionally stable granite or epoxy-granite base 220. A spherical-action bearing 184 allows the platen 178 to freely float with a spherical action motion during the lapping operation. A right-angle gear box 194 has a hollow drive shaft to provide vacuum to attach raised island abrasive disks 176 to the platen 178. Vacuum 190 is applied to a rotary union 192 that allows rotation of the gear box 194 drive hollow shaft to route vacuum to the platen 178 through tubing or other passageway devices (not shown) where abrasive disks 176 can be attached to the platen 178 by vacuum. The spherical bearing 184 can be a roller bearing or an air bearing having an air passage 182 that allows pressurized air to be applied to create an air bearing effect or vacuum to be applied to lock the spherical bearing 184 rotor and housing components together. One or more conventional universal joints or plate-type universal joints or constant velocity universal joints or a set of two constant velocity universal joints 186, 188 attached to the drive shaft allow the spherical rotation and cylindrical rotation motion of the rotating platen 178.

The pivot frame 196 can be rotated to desired positions and locked at the desired rotation position by use of a pivot frame locking device 206 that is attached to the pivot frame 196 and to the pivot frame 196 elevation frame 216. The pivot frame 196 can be raised or lowered to selected elevation positions by the electric motor screw jack 218 or by a hydraulic jack 218 that is attached to the machine base 220 and to the pivot frame 196 elevation frame 216 where the pivot frame 196 elevation frame 216 is supported by a translatable slide device 214 that is attached to the machine base 220.

Pivot-Balance Platen Spherical Rotation

When the pivot frame is raised by the pair of electric actuators (or by hydraulic cylinders) and tilted, the floating platen can also be rotated back into a horizontal position because of the use of a spherical-action platen shaft bearing. The drive shafts that are used to rotate the platen are connected with constant velocity universal joints to the platen drive shaft and to the gear box drive shaft. These universal joints allow the floating platen to have a spherical rotation while rotational power is supplied by the drive shafts to rotate the platen. The constant velocity universal joints are sealed and are well suited for use in a harsh abrading environment. If desired, the platen can be rotated at very low speeds while the pivot frame is tilted and the platen is tilted back where the abrading surface is nominally horizontal.

Figure 7:
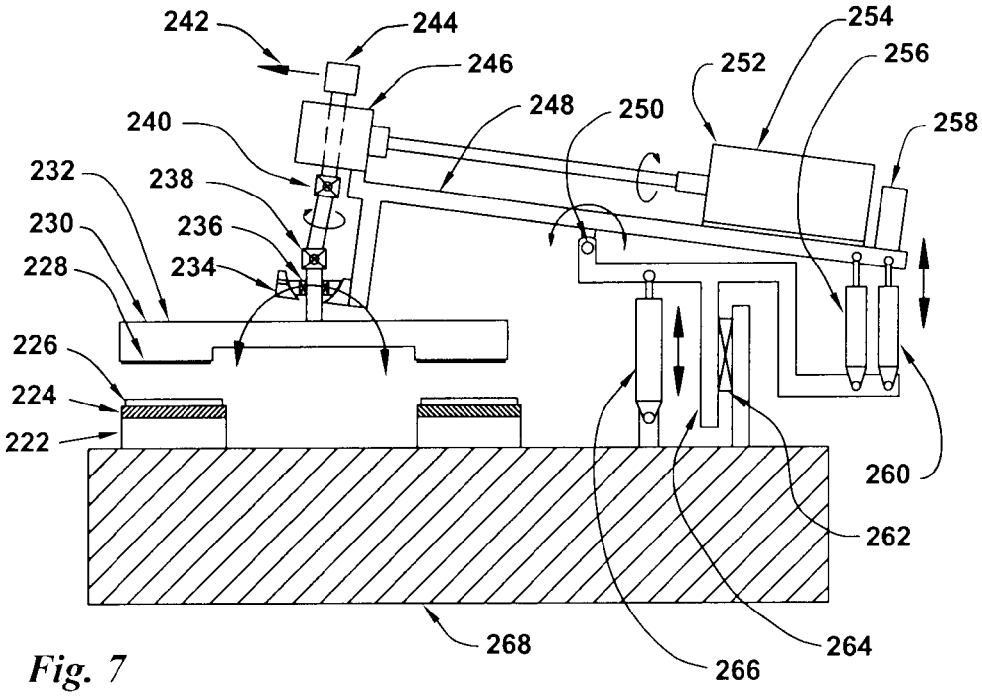
FIG. 7 is a cross section view of a raised floating-platen lapper with a horizontal platen.

FIG. 7 is a cross section view of a raised pivot-balance floating-platen lapper machine with a horizontal platen. Here, the pivot frame is raised and rotated and the floating-platen is rotated back to a nominally horizontal position. The pivot-balance floating-platen lapping machine 252 provides these desirable features. The lapper machine 252 components such as the platen drive motor 254 and a counterweight 258 are used to counterbalance the weight of the abrasive platen assembly 232 where the pivot frame 248 is balanced about the pivot frame 248 pivot center 250. Vacuum 242 is applied to a rotary union 244 that allows rotation of the gear box 246 drive hollow shaft to route vacuum 242 to the platen 230 through tubing or other passageway devices (not shown) where abrasive disks 228 can be attached to the platen 230 by vacuum.

The pivot frame 248 has a rotation axis centered at the pivot frame pivot center 250 where the platen assembly 232 is attached at one end of the pivot frame 248 from the pivot center 250 and the platen motor 254 and a counterbalance weight 258 are attached to the pivot frame 248 at the opposed end of the pivot frame 248 from the pivot center 250. The pivot frame 248 has low friction rotary pivot bearings at the pivot center 250 where the pivot bearings can be frictionless air bearings or low friction roller bearings. The platen drive motor 254 is attached to the pivot frame 248 in a position where the weight of the platen drive motor 254 nominally or partially counterbalances the weight of the abrasive platen assembly 232. A movable and weight-adjustable counterweight 258 is attached to the pivot frame 248 in a position where the weight of the counterweight 258 partially counterbalances the weight of the abrasive platen assembly 232. The weight of the counterweight 258 is used together with the weight of the platen motor 254 to effectively counterbalance the weight of the abrasive platen assembly 232 that is also attached to the pivot frame 248. When the pivot frame 248 is counterbalanced, the pivot frame 248 pivots freely about the pivot center 250. The platen drive motor 254 rotates a drive shaft 23 that is coupled to the gear box 246 to rotate the gear box 246 hollow drive shaft.

The whole pivot frame 248 can be raised or lowered from a machine base 268 by a elevation frame 264 lift device 266 that can be an electric motor driven screw jack lift device or a hydraulic lift device. The elevation frame 264 lift device 266 can have a position sensor that can be used to precisely control the vertical position of the elevation frame 264. Zero-friction air bearing cylinders 260 can be used to apply the desired abrading forces to the platen 230 as it is held in 3-point abrading contact with the workpieces 226 attached to rotary spindles 222 having rotary spindle-tops 224. One end of one or more air bearing cylinders 260 can be attached to the pivot frame 248 at different positions to apply forces to the pivot frame 248 where these applied forces provide an abrading force to the platen 230. The support end of the air bearing cylinders 260 can also be attached to the elevation frame 264. The floating platen 230 has a spherical rotation and a cylindrical rotation that is provided by the spherical-action platen support bearing 236 that supports the weight of the floating platen 230 where the spherical-action platen support bearing 236 is supported by the pivot frame 248.

The air pressure applied to the air cylinder 260 is typically provide by an I/P (electrical current-to-pressure) pressure regulator (not shown) that is activated by an abrading process controller (not shown). The actual force generated by the air cylinder 260 can be sensed and verified by an electronic force sensor load cell that is attached to the cylinder rod end of the air cylinder 260. The force sensor allows feed-back type closed-loop control of the abrading pressure that is applied to the workpieces 226. Abrading pressures on the workpieces 226 can be precisely changed throughout the lapping operation by the lapping process controller.

The spindles 222 are attached to a dimensionally stable granite or epoxy-granite base 268. A spherical-action bearing 236 allows the platen 230 to freely float with a spherical action motion during the lapping operation. A right-angle gear box 158 has a hollow drive shaft to provide vacuum to attach raised island abrasive disks 228 to the platen 230. Vacuum 242 is applied to a rotary union 244 that allows rotation of the gear box 246 drive hollow shaft to route vacuum 242 to the platen 230 through tubing or other passageway devices (not shown) where abrasive disks 228 can be attached to the platen 230 by vacuum. The spherical bearing 236 can be a spherical roller bearing or an air bearing having an air passage 234 that allows pressurized air to be applied to create an air bearing effect or vacuum to be applied to lock the spherical bearing 236 rotor and housing components together. One or more conventional universal joints or plate-type universal joints or constant velocity universal joints or a set of two constant velocity universal joints 238, 240 attached to the drive shaft allow the spherical rotation motion and the cylindrical rotation motion of the rotating platen 230 that rotates the abrasive disk 228 when the abrasive disk 228 is in abrading contact with workpieces 226.

The pivot frame 248 can be rotated to desired positions and locked at the desired rotation position by use of a pivot frame locking device 256 that is attached to the pivot frame 248 and to the pivot frame 248 elevation frame 264. The pivot frame 248 can be raised or lowered to selected elevation positions by the electric motor screw jack 266 or by a hydraulic jack 266 that is attached to the machine base 268 and to the pivot frame 248 elevation frame 264 where the pivot frame 248 elevation frame 264 is supported by a translatable slide device 262 that is attached to the machine base 268.

Pivot-Balance Lapper Frame

A top view of the pivot-balance lapping machine shows how this lightweight framework and platen assembly has widespread support members that provide unusual stiffness to the abrading system. The two primary supports of the pivot frame are the two linear slides that have a very wide stance by being positioned at the outboard sides of the rigid granite base. The two precision-type heavy-duty sealed pivot frame linear slides have roller bearings that provide great structural rigidity for the abrasive platen as the platen rotates during the lapping operation.

Very low friction pivot bearings are used on the pivot shaft to minimize the pivot shaft friction as the pivot frame rotates. Because this pivot shaft friction is so low, the exact abrading force that is generated by the pivot abrading force air cylinder is transmitted to the abrading platen during the lapping operation. Cylindrical air bearings can provide zero-friction rotation of the pivot frame support shaft even when the pivot frame and platen system is quite heavy.

Figure 8:
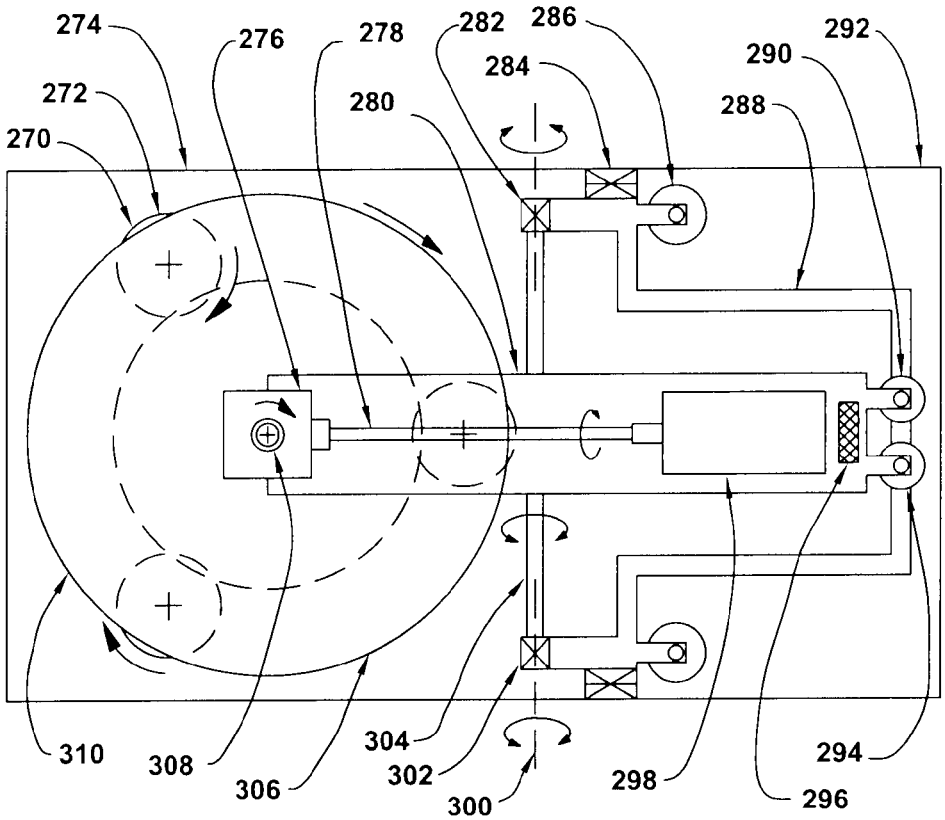
FIG. 8 is a top view of a pivot-balance floating-platen lapper machine.

FIG. 8 is a top view of a pivot-balance floating-platen lapper machine. The pivot-balance floating-platen lapping machine 274 components include the platen drive motor 298 and a counterweight 296 are that are used to counterbalance the weight of the abrasive platen assembly 306 where the pivot frame 280 is balanced about the pivot frame 280 pivot center 282 rotation axis 300.

The pivot frame 280 has a rotation axis 300 centered at the pivot frame pivot center 282 where the platen assembly 306 is attached at one end of the pivot frame 280 from the pivot axis 300 and the platen motor 298 and a counterbalance weight 296 are attached to the pivot frame 280 at the opposed end of the pivot frame 280 from the pivot axis 300. The pivot frame 280 has low friction rotary pivot bearings 302 at the pivot center 282 where the pivot bearings 302 can be frictionless air bearings or low friction roller bearings. The radial stiffness of these pivot frame 280 air bears 302 are typically much stiffer than equivalent roller bearings 302. The platen drive motor 298 is attached to the pivot frame 280 in a position where the weight of the platen drive motor 298 nominally or partially counterbalances the weight of the abrasive platen assembly 306. A movable and weight-adjustable counterweight 296 is attached to the pivot frame 280 in a position where the weight of the counterweight 296 partially counterbalances the weight of the abrasive platen assembly 306. The weight of the counterweight 296 is used together with the weight of the platen motor 298 to effectively counterbalance the weight of the abrasive platen assembly 306 that is also attached to the pivot frame 280. When the pivot frame 280 is counterbalanced, the pivot frame 280 pivots freely about the pivot axis 300. The platen drive motor 298 rotates a drive shaft 278 that is coupled to the gearbox 276 to rotate the gearbox 276 hollow abrading platen 310 rotary drive shaft 308.

The whole pivot frame 280 can be raised or lowered from a machine base 292 by a elevation frame 288 lift device 286 that can be an electric motor driven screw jack lift device or a hydraulic lift device. The elevation frame 288 lift device 286 is attached to a linear slide 284 that is attached to the machine base 292 and also is attached to the elevation lift frame 288 where the elevation lift frame 288 lift device 286 can have a position sensor (not shown) that can be used to precisely control the vertical position of the elevation lift frame 288.

The elevation frame 288 can be raised with the use of an elevation frame 288 lift devices 286 such as a pair of electric jacks such as a linear actuator produced by Exlar Corporation, Minneapolis, Minn. These linear actuators can provide closed-loop precision control of the position of the elevation frame 288 and are well suited for long term use in a harsh abrading environment. When the elevation frame 288 and the pivot frame 280 and the abrasive platen assembly 306 and the floating platen 310 are raised, workpieces can be changed and the abrasive disks (not shown) that are attached to the platen can be easily changed. Here the floating platen 310 is allowed to have a spherical motion floatation and cylindrical rotation with the use of a spherical-action platen shaft bearing (not shown that rotates the abrasive disk when the abrasive disk is in abrading contact with workpieces (not shown).

Zero-friction air bearing cylinders 290 can be used to apply the desired abrading forces to the platen 310 as it is held in 3-point abrading contact with the workpieces 270 attached to rotary spindles 272 having rotary spindle-tops. One end of one or more air bearing cylinders 290 can be attached to the pivot frame 280 at different positions to apply forces to the pivot frame 280 where these applied forces provide an abrading force to the platen 310. The support end of the air bearing cylinders 290 can be attached to the elevation frame 288. A pivot frame 280 locking device 294 is attached both to the pivot frame 280 locking and the elevation frame 288.

The top view of the pivot-balance lapping machine 274 shows how this lightweight framework and platen assembly has widespread support members that provide unusual stiffness to the abrading system. The two primary supports of the pivot frame are the two linear slides 284 that have a very wide stance by being positioned at the outboard sides of the rigid granite, epoxy-granite, cast iron or steel machine base 292. The two precision-type heavy-duty sealed pivot frame machine tool type linear slides 284 have roller bearings that provide great structural rigidity for the lapping machine 274 and particularly for the abrasive platen 310 when the platen 310 is rotated during the lapping operation.

Very low friction pivot bearings 302 are used on the pivot shaft 304 to minimize the pivot shaft 304 friction as the pivot frame 280 rotates. Because this pivot shaft 304 friction is so low, the abrading force that is generated by the pivot abrading force air cylinder 290 is transmitted without friction-distortion to the abrading platen 310 during the lapping operation. Cylindrical air bearings 302 can provide zero-friction rotation of the pivot frame 280 support shaft 304 even when the pivot frame 280 and platen assembly 306 is quite heavy.

The pivot-balance floating-platen lapping machine 274 is an elegantly simple abrading machine that provides extraordinary precision control of abrading forces for this abrasive high speed flat lapping system. All of its components are all robust and are well suited for operation in a harsh abrading atmosphere with minimal maintenance.

Figure 9:
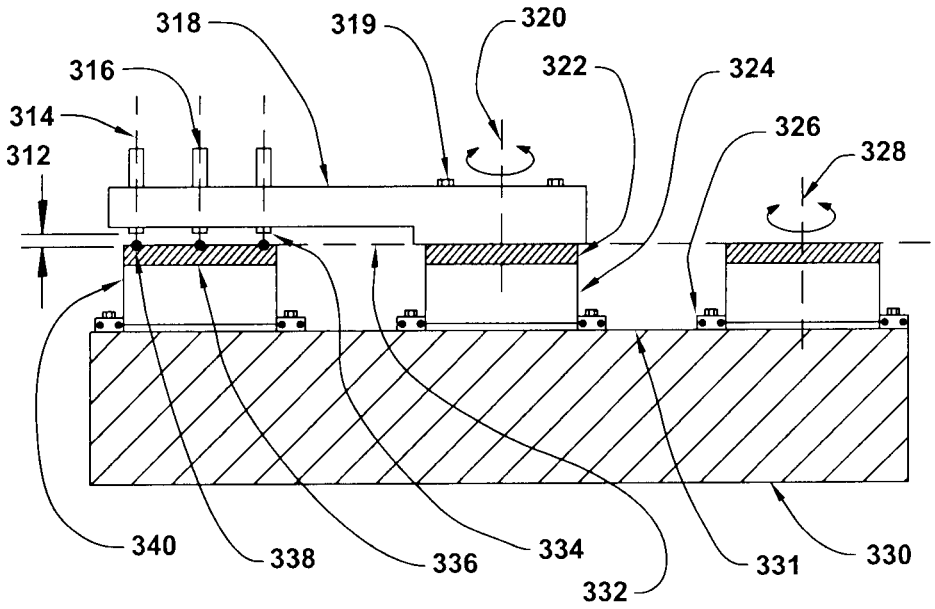
FIG. 9 is a cross section view of an air bearing spindle laser spindle top alignment device.

FIG. 9 is a cross section view of an air bearing spindle mounted laser co-planar spindle top alignment device. Air bearing rotary workpiece spindles 324, 340 are mounted on a granite lapper machine base 330 having a flat surface 331. The rotary workpiece spindles 324, 340 having flat top surfaces are located at the outer periphery of the circular or rectangular shaped machine base 330 where these workpiece spindles 324, 340 are positioned with near-equal distances between them. A laser sensor arm 318 is attached to the flat surface of a selected rotary alignment workpiece spindle 324 spindle-top 322 using mechanical fasteners 319 or vacuum where the rotary spindle-top 322 of the selected workpiece spindle 324 can be rotated about an axis 320 to selected positions.

Three laser sensors 316 are shown attached to the laser sensor arm 318 where the laser distance sensors 316 having respective laser beam axes 314 can be used to measure the precise laser span distance 312 between the laser sensor 316 bottom laser sensor end 334 and targets 338 located on the flat surfaces of the non-selected workpiece spindle's 340 spindle-tops 336. The distance measurement sensors are referred to here as laser sensors but other distance measurement sensors can be used interchangeably with the laser sensors. These other distance measurement sensors include capacitance sensors, eddy current sensors, mechanical measurement devices, dial-indicator measurement devices, air-gap sensors or ultrasonic distance sensors.

One or more of the three laser distance sensors 316 can also be used to measure the precise laser span distances to select targets that are located on the flat surface 331 of the machine base 330. The select targets that are located on the flat surface 331 of the machine base 330 are typically aligned in a line that extends radially from the center of the machine base 330 so that the laser span distances of all three select targets can be measured simultaneously by the distance measuring sensors 316. The selected target points on the machine base 330 top surface 331 can be target areas or the selected target points on the machine base 330 top surface 331 can be reflective target devices.

The laser sensor arm 318 that is attached to the top flat surface of the selected rotary workpiece alignment spindle 324 spindle-top 322 can be rotated to align the laser distance sensors 316 with the selected measurement targets 338 located on the surfaces of the workpiece spindles 340 spindle-tops 336 and also to be aligned with targets (not shown) that are located on the flat surface 331 of the machine base 330. The selected target points 338 on the surfaces of the non-selected workpiece spindles 340 spindle-tops 336 can be target areas or the selected distance measurement sensors target points 338 on the respective surfaces of the at least three workpiece spindle's rotary spindle-tops or the selected target points 338 on the machine base top surface can be reflective target devices.

Each of the non-selected workpiece spindles 340 have height adjustable support legs 326 that are adjusted in height to align the top flat surfaces of the workpiece spindle-tops 336 to be co-planar in a plane 332 with the selected alignment workpiece spindle 324 spindle-top flat surface. Also, the selected alignment spindle 324 has height adjustable support legs that can be adjusted in height to align the flat top surface of the alignment spindle 324 spindle-top 322 to be parallel with the granite base 330 flat top surface 331. It is preferred, but not necessary, that the alignment spindle 324 height adjustable support legs are adjusted in height to align the flat top surface of the alignment spindle 324 spindle-top 322 to be parallel to the granite base 330 flat top surface 331.

The workpiece spindles 340 are rotated about an axis 328 to incremental positions or the workpiece spindles 340 are rotated about an axis 328 at rotational speeds when the laser span distances 312 are measured to provide span distance 312 measurements having improved-accuracy dynamic readings by averaging multiple target 338 points on the surface of the spindle-tops 336 as the spindle-tops 336 are rotated. The granite construction material of the machine base 330 provides long term dimensional stability and rigidity that allows the workpiece spindle's 324, 340 spindle-tops 336 precision co-planar alignment to be maintained over long periods of time even when the workpiece spindles 340 spindle are subjected to abrading forces during flat lapping operations.

This workpiece spindle's 324, 340 spindle-tops 336 precision co-planar alignment procedure can be made by selecting other workpiece spindle's 324, 340 spindle-tops 336 for attachment of the laser sensor arm 318 to make distance measurements to targets 338 located on the flat surfaces of the non-selected workpiece spindle's 340 spindle-tops 336. In addition, the workpiece spindle's 324, 340 spindle-tops 336 precision co-planar alignment procedure can be repeated where the co-planar alignment of the at least three workpiece spindles' 324, 340 spindle-tops 336 precision-flat surfaces so that they are co-planar with each other is repeated one or more times by using the same selected workpiece alignment spindle 324 for attachment of the measurement arm device 318 or by selecting another of the workpiece spindles 340 for attachment of the measurement arm device 318 to progressively decrease the out-of-plane dimensional variations of the co-planar alignment of the at least three workpiece spindles' 324, 340 spindle-tops 336 precision-flat surface from the plane 332.

Also, the parallel alignment of the selected workpiece spindle's 324 rotary spindle-top's 322 flat surface with the surface 331 of the machine base 330 is repeated one or more times to progressively decrease the non-parallel dimensional variations of the parallel alignment of the selected workpiece spindle's 324 rotary spindle-top's 322 flat surface with the surface 331 of the machine base 330.

Figure 10:
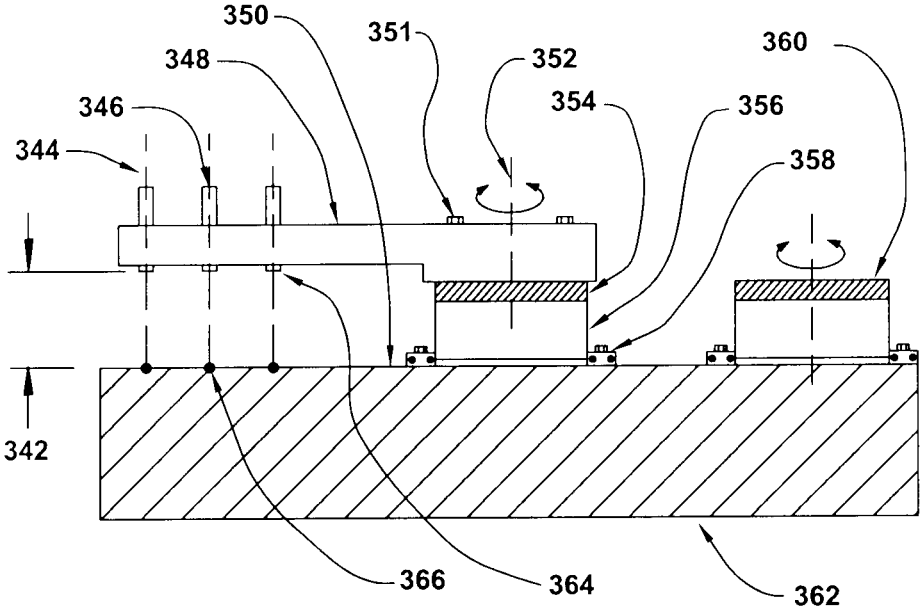
FIG. 10 is a cross section view of an air bearing spindle laser arm used to align spindles.

FIG. 10 is a cross section view of an air bearing spindle mounted laser arm used to align the alignment spindle device. A selected air bearing rotary alignment spindle 356 is mounted on a granite lapper machine base 362 having a flat top surface 350. The selected rotary alignment spindle 356 and the non-selected rotary workpiece spindles 360 having flat rotary surfaces are located at the outer periphery of the circular or rectangular shaped machine base 362 where these workpiece spindles 356, 360 are positioned with near-equal distances between them. A laser sensor arm 348 is attached to the selected rotary alignment spindle 356 spindle-top 354 where the rotary spindle-top 354 of the alignment spindle 356 can be rotated about an axis 352 to selected positions.

Three laser distance sensors 346 are shown attached to the laser sensor arm 348 where the laser distance sensors 346 having respective laser beam axes 344 can be used to measure the precise laser span distance 342 between the laser sensors 346 bottom laser sensor ends 364 and targets 366 located on the flat surface 350 of the machine base 362. The select targets 366 that are located on the flat surface 350 of the machine base 362 are typically aligned in a line so that the laser span distances 342 of all three select targets can be measured simultaneously by the respective three distance measuring sensors 346. The selected target points 366 on the machine base 362 top surface 350 can be target areas or the selected distance measurement sensors target points 366 the machine base 362 top surface 350 can be reflective target devices.

The laser sensor arm 348 that is attached to the top flat surface of the selected rotary alignment spindle 356 spindle-top 354 using mechanical fasteners 351 or vacuum can be rotated manually or by a rotation drive device (not shown) about the axis 352 to align the laser distance sensors 346 with the selected measurement targets 366 that are located on the flat top surface 350 of the machine base 362. The selected alignment spindle 356 has height-adjustable support legs 358 that are adjusted in height to align the flat top surface of the alignment spindle 356 spindle-top 354 to be parallel with the granite base 362 flat top surface 350.

Figure 11:
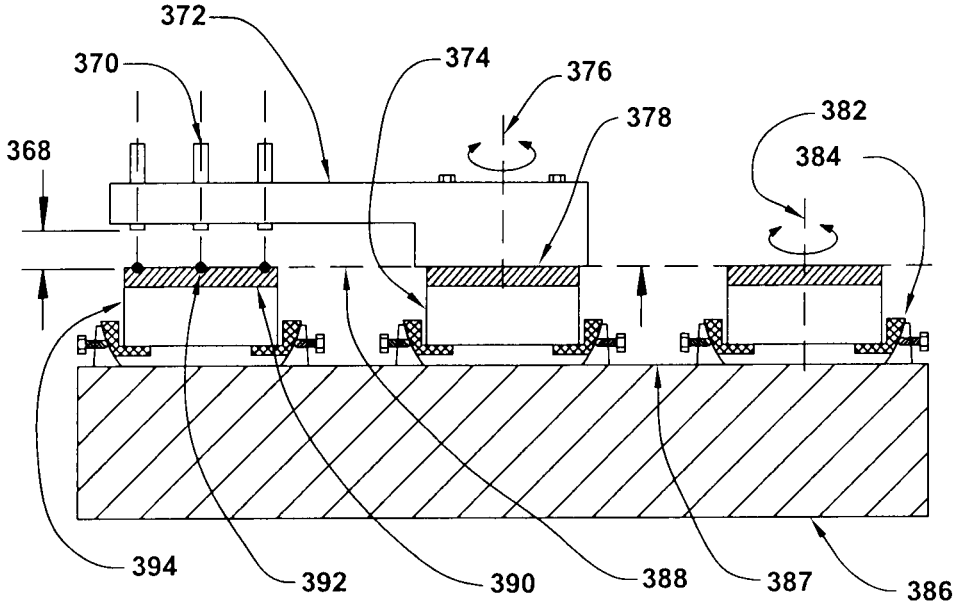
FIG. 11 is a cross section view of an air bearing spindle laser spindle alignment device.

FIG. 11 is a cross section view of an elevated air bearing spindle mounted laser spindle alignment device. A selected air bearing rotary alignment spindle 374 is mounted on a granite lapper machine base 386 having a flat surface. Non-selected rotary workpiece spindles 394 and the selected air bearing rotary alignment spindle 374 having flat surfaces are located at the outer periphery of the circular or rectangular shaped machine base 386 where these workpiece spindles 374, 394 are positioned with near-equal distances between them. A laser sensor arm 372 is attached to the selected rotary alignment spindle 374 spindle-top 378 where the rotary spindle-top 378 of the selected alignment spindle 374 can be rotated about an axis 376 to selected positions.

Three laser distance sensors 370 are shown attached to the laser sensor arm 372 where the laser distance sensors 370 having respective laser beam axes can be used to measure the precise laser span distance 368 between the laser sensor 370 bottom laser sensor end and targets 392 located on the flat surfaces of the workpiece spindle's 394 spindle-tops 390. One or more of the three laser distance sensors 370 can also be used to measure the precise laser span distances to select targets that are located on the flat surface of the machine base 386. The select targets that are located on the flat surface of the machine base 386 are typically aligned in a line that extends radially from the center of the machine base 386 so that the laser span distances of all three select targets can be measured simultaneously by the distance measuring sensors 370.

The laser sensor arm 372 that is attached to the top flat surface of the selected rotary alignment spindle 374 spindle-top 378 can be rotated to align the laser distance sensors 370 with the selected measurement targets 392 located on the surfaces of the non-selected workpiece spindles 394 spindle-tops 390 and also to be aligned with targets that are located on the flat surface of the machine base 386. Each of the non-selected workpiece spindles 394 have spherical-action spindle mounts 384 that are rotated to align the top flat surfaces of the workpiece spindle-tops 390 to be co-planar in a plane 388. Also, the selected alignment spindle 374 has a spherical-action spindle mount 384 that can be are rotated to align the flat top surface of the alignment spindle 374 spindle-top 378 to be parallel with the granite base 386 flat top surface.

The workpiece spindles 394 are rotated about an axis 382 to incremental positions or the workpiece spindles 394 are rotated about an axis 382 at rotational speeds when the laser span distances 368 are measured to provide span distance 368 measurements having improved-accuracy dynamic readings by averaging multiple target 392 points on the surface of the spindle-tops 390 as the spindle-tops 390 are rotated. The granite construction material of the machine base 386 provides long term dimensional stability and rigidity that allows the workpiece spindle's 394 spindle-tops 390 precision co-planar alignment to be maintained over long periods of time even when the workpiece spindles 394 spindle are subjected to abrading forces during flat lapping operations.

The workpiece spindles 394 can be attached directly to the granite base 386 or they can be attached to spindle 394 spherical-action spindle mounts 384 after the flat surfaces of the spindle-tops 378 are aligned to be co-planar to each other or after the flat surface of the spindle-top 378 is aligned to be parallel to the machine base 386 nominally-flat top surface 387.

Figure 12:
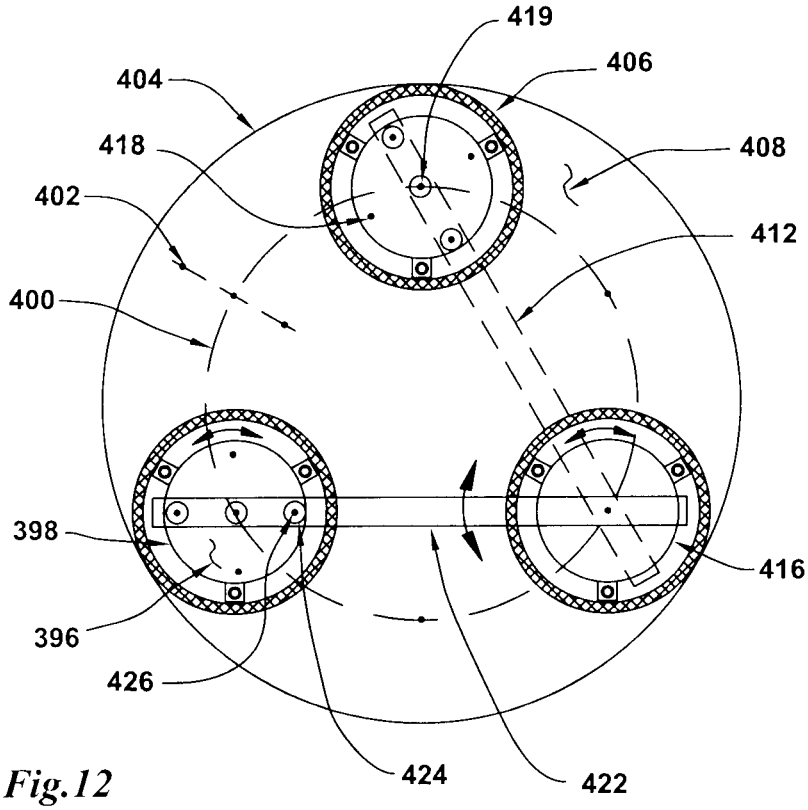
FIG. 12 is a top view of an air bearing spindle laser spindle alignment device.

FIG. 12 is a top view of an air bearing spindle laser co-planar spindle top alignment device. Air bearing or roller bearing rotary workpiece spindles 398 are mounted on a flat surface 408 of a granite lapper machine base 404. Rotary workpiece spindles 398 having flat surfaces 396 are located at the outer periphery of the circular shaped machine base 404 where these workpiece spindles 398 are positioned with near-equal distances between them. A laser sensor arm 422 is attached to a selected rotary alignment workpiece spindle 398 spindle-top 416 where the rotary spindle-top 416 of the alignment spindle 398 can be rotated to selected positions.

Three laser distance sensors 424 are shown attached to the laser sensor arm 422 where the laser distance sensors 424 having respective laser beam axes 426 can be used to measure the precise laser span distance between the laser sensor 424 bottom laser sensor end (not shown) and targets 418 located on the flat surfaces 396 of the workpiece spindle's 398 spindle-tops 416. One or more of the three laser distance sensors 424 can also be used to measure the precise laser span distances to select targets 402 that are located on the flat surface 408 of the machine base 404. The select targets 402 that are located on the flat surface 408 of the machine base 404 are typically aligned in a line so that the laser span distances of all three select targets 402 can be measured simultaneously by the distance measuring sensors 424.

The laser sensor arm 422 that is attached to the top flat surface of the rotary alignment spindle 398 spindle-top 416 can be rotated to align the laser distance sensors 424 with the selected measurement targets 418 located on the surfaces of the workpiece spindles 398 spindle-tops 416 and also to be aligned with targets 402 that are located on the flat surface 408 of the machine base 404. The laser sensor arm 422 is shown also in an alternative measurement location as laser sensor arm 412. Each of the workpiece spindles 398 is mounted on a spherical-action spindle mount 406 that can be adjusted by spherical rotation to align the workpiece spindle-top's 416 flat surfaces 396 to be co-planar with the selected alignment workpiece spindle 398 spindle-top 416 flat surface 396. Also, the selected alignment spindle 398 is mounted on a spherical-action spindle mount 406 that can be adjusted by spherical rotation to align the flat top surface 396 of the selected alignment spindle 398 spindle-tops 416 to be parallel with the granite base 404 flat surface 408.

The three workpiece spindles 398 are mounted on the flat surface 408 of the machine base 404 where the rotational axes of the spindle tops 416 that intersects the spindle tops 416 rotation-center target point 419 intersects a spindle-circle 400 where the spindle-circle 400 is coincident with the machine base 404 nominally-flat top surface 408. The workpiece spindles 398 can be attached directly to the granite base 404 or they can be attached to spindle 398 spherical-action spindle mounts 406 after the flat surface of the spindle-top 416 is aligned to be parallel to the machine base 404 nominally-flat top surface 408.

Figure 13:
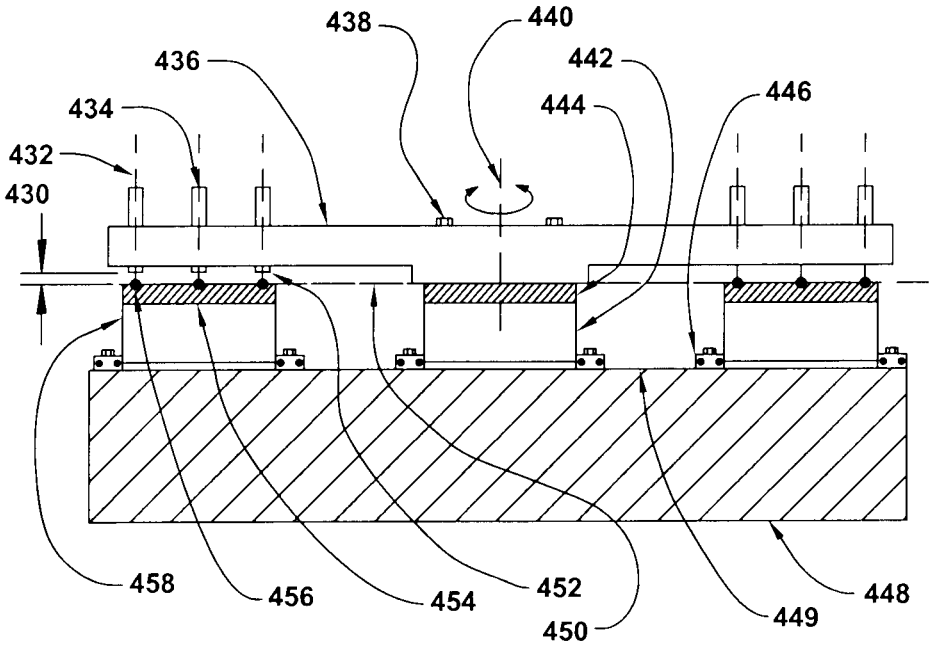
FIG. 13 is a cross section view of an air bearing laser co-planar spindle top alignment device.

FIG. 13 is a cross section view of an air bearing spindle mounted laser co-planar spindle top alignment device. A selected air bearing rotary alignment spindle 442 is mounted on a granite lapper machine base 448 having a flat surface 449. The air bearing rotary alignment spindle 442 can be mounted on the granite lapper machine base 448 with the use of mechanical fasteners or by use of adhesives.

Rotary workpiece spindles 458 having flat surfaces are located at the outer periphery of the circular or rectangular shaped machine base 448 where these workpiece spindles 458 are positioned with near-equal distances between them and they surround the alignment spindle 442. A laser sensor dual arm 436 having two opposed arm sections is attached to a selected rotary alignment spindle 442 spindle-top 444 using mechanical fasteners 319 or vacuum where the rotary spindle-top 444 of the selected alignment workpiece spindle 442 can be rotated about an axis 440 to selected positions.

Three laser distance sensors 434 are shown attached to each opposed leg of the laser sensor dual arm 436 where the laser distance sensors 434 having respective laser beam axes 432 can be used to measure the precise laser span distance 430 between the laser sensor 434 bottom laser sensor end 452 and targets 456 located on the flat surfaces of the workpiece spindle's 458 spindle-tops 454. One or more of the three laser distance sensors 434 located on each of the opposed dual arm legs can also be used to measure the precise laser span distances to select targets that are located on the flat surface 449 of the machine base 448. The select targets that are located on the flat surface 449 of the machine base 448 are typically aligned in a line so that the laser span distances of all three select targets can be measured simultaneously by the distance measuring sensors 434.

The laser sensor arm 436 that is attached to the top flat surface of the selected rotary alignment workpiece spindle 442 spindle-top 444 can be rotated to align the laser distance sensors 434 with the selected measurement targets 456 located on the surfaces of the non-selected workpiece spindles 458 spindle-tops 454 and also to be aligned with targets that are located on the flat surface 449 of the machine base 448. Each of the non-selected workpiece spindles 458 have height adjustable support legs 446 that are adjusted in height to align the top flat surfaces of the non-selected workpiece spindle-tops 454 to be co-planar in a plane 450 with the selected alignment workpiece spindle 442 spindle-top flat surface. Also, the alignment spindle 442 has height adjustable support legs that can be adjusted in height to align the flat top surface of the alignment spindle 442 spindle-top 444 to be parallel with the granite base 448 flat top surface. It is preferred, but not necessary, that the alignment spindle 442 height adjustable support legs are adjusted in height to align the flat top surface of the selected alignment workpiece spindle 442 spindle-top 444 to be parallel to the granite base 448 flat top surface 449.

The workpiece spindles 458 are rotated about an axis (not shown) to incremental positions or the workpiece spindles 458 are rotated about the axis at rotational speeds when the laser span distances 430 are measured to provide span distance 430 measurements having improved-accuracy dynamic readings by averaging multiple target 456 points on the surface of the spindle-tops 454 as the spindle-tops 454 are rotated. The granite construction material of the machine base 448 provides long term dimensional stability and rigidity that allows the workpiece spindle's 458 spindle-tops 454 precision co-planar alignment to be maintained over long periods of time even when the workpiece spindles 458 spindle are subjected to abrading forces during flat lapping operations.

Figure 14:
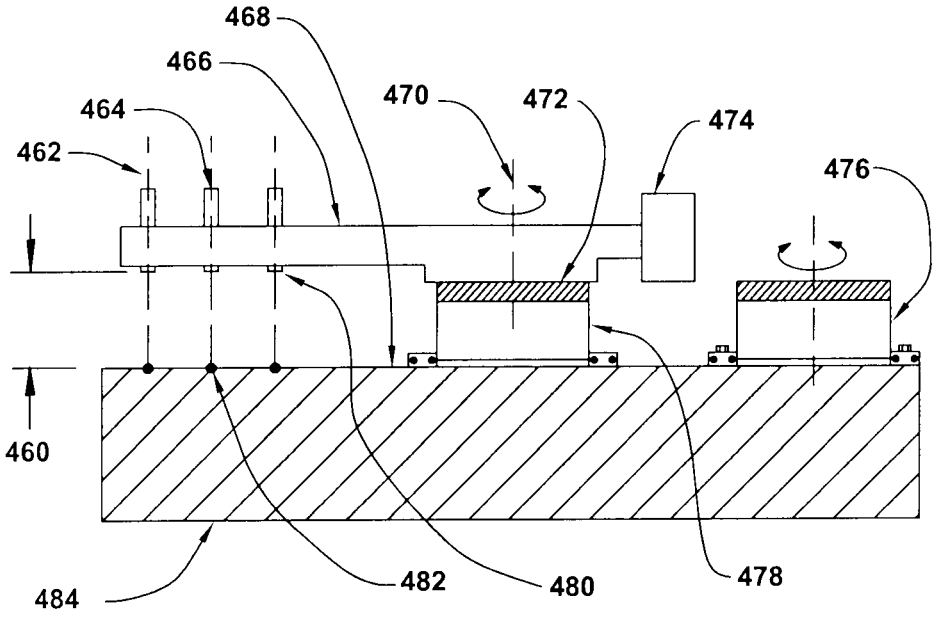
FIG. 14 is a cross section view of a spindle mounted laser arm used alignment device.

FIG. 14 is a cross section view of an air bearing spindle mounted laser arm used to align the alignment spindle device. A selected air bearing rotary alignment workpiece spindle 478 is mounted on a granite lapper machine base 484 having a flat top surface 468. The air bearing or roller bearing rotary workpiece spindles 476, 478 can be mounted on the granite lapper machine base 484 with the use of mechanical fasteners (not shown) or by use of vacuum or adhesives.

Rotary workpiece spindles 476, 478 having flat rotary surfaces are located at the outer periphery of the circular or rectangular shaped machine base 484 where these workpiece spindles 476, 478 are positioned with near-equal distances between them. A laser sensor arm 466 is attached to the selected rotary alignment workpiece spindle 478 spindle-top 472 by vacuum or by mechanical fasteners where the rotary spindle-top 472 of the selected alignment spindle 478 can be rotated about an axis 470 to selected angular positions.

Three laser distance sensors 464 are shown attached to the laser sensor arm 466 where the laser distance sensors 464 having respective laser beam axes 462 can be used to measure the respective precise laser span distances 460 between the laser sensors 464 bottom laser sensor ends 480 and targets 482 located on the flat surface 468 of the machine base 484. The select targets 482 that are located on the flat surface 468 of the machine base 484 are typically aligned in a line so that the laser span distances 460 of all three select targets can be measured simultaneously by the respective three distance measuring sensors 464.

The laser sensor arm 466 that is attached to the top flat surface of the rotary alignment spindle 478 spindle-top 472 using mechanical fasteners or vacuum can be rotated manually or by a rotation drive device (not shown) about the axis 470 to align the laser distance sensors 464 with the selected measurement targets 482 that are located on the flat top surface 468 of the machine base 484. The selected alignment workpiece spindle 478 has height-adjustable support legs that are adjusted in height to align the flat top surface of the alignment spindle 478 spindle-top 472 to be parallel with the granite base 484 flat top surface 468. To minimize the torque-force load that is applied by the laser sensor arm 466 that tends to tilt the selected alignment workpiece spindle 478 spindle-top 472, a counterbalance weight 474 is attached to the end portion of the lasers sensor arm 466 that is opposed to the end portion of the lasers sensor arm 466 that the laser distance sensors 464 are attached to.

Figure 15:
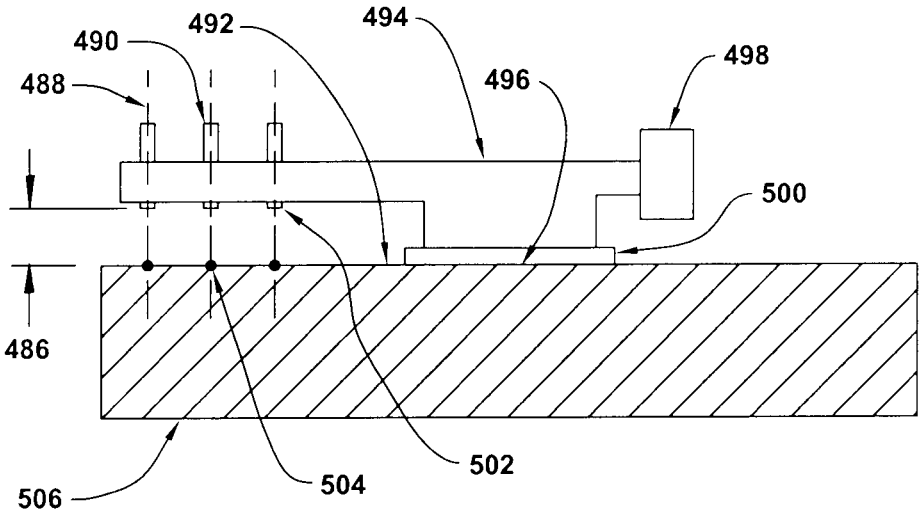
FIG. 15 is a cross section view of a laser arm used to co-planar align workpiece spindles.

FIG. 15 is a cross section view of a laser measurement device arm 494 that is used to co-planar align the top flat surfaces of rotary workpiece spindles (not shown). The laser measurement arm 404 is mounted on a precision-flat surface plate 506 having a flat top surface 492. The laser measurement device arm 494 has an attachment base plate 500 that can be attached in flat-surfaced contact to the surface plate 506 where the weight of the laser measurement device arm 494 is sufficient to hold the laser measurement device arm 494 in a stable condition during calibration or measurement procedures. Also, the attachment base plate 500 can be attached to the surface plate 506 surface 492 with fasteners or vacuum. The surface plate 506 can be a metal plate, a cast iron plate, a granite plate or a epoxy-granite plate.

Three laser distance sensors 490 are shown attached to the laser sensor arm 494 where the laser distance sensors 490 having respective laser beam axes 488 can be used to measure the respective precise laser span distances 486 between the laser sensors 490 bottom laser sensor ends 502 and select targets 504 or selected target areas 504 located on the flat surface 492 of the surface plate 506. By making these measurements, a calibration can be made of each laser distance sensor 490 distance 486 to establish the precisely accurate distance 486 between each of the laser sensors 490 bottom laser sensor ends 502 and the selected targets 504 located on the flat surface 492 of the surface plate 506. These laser sensors 490 distance calibrations can be used in subsequent alignment procedures to co-planar align the top flat surfaces of rotary workpiece spindles.

The flatness accuracy of the precision-flat surface 492 of the surface plate 506 precision-flat surface plate is defined as having out-of-plane variations of less than 0.002 inches but preferably less than 0.0005 inches and most preferably less than 0.0001 inches. Also, the flatness accuracy of the precision-flat surface 496 of the measurement device arm 494 attachment base plate 500 is defined as having out-of-plane variations of less than 0.002 inches but preferably less than 0.0005 inches and most preferably less than 0.0001 inches.

To minimize the torque-force load that is applied by the laser sensor measurement arm 494 that tends to tilt the laser sensor measurement arm 494, a counterbalance weight 498 is attached to the end portion of the lasers sensor arm 494 that is opposed to the end portion of the lasers sensor arm 494 that the laser distance sensors 490 are attached to.

Figure 16:
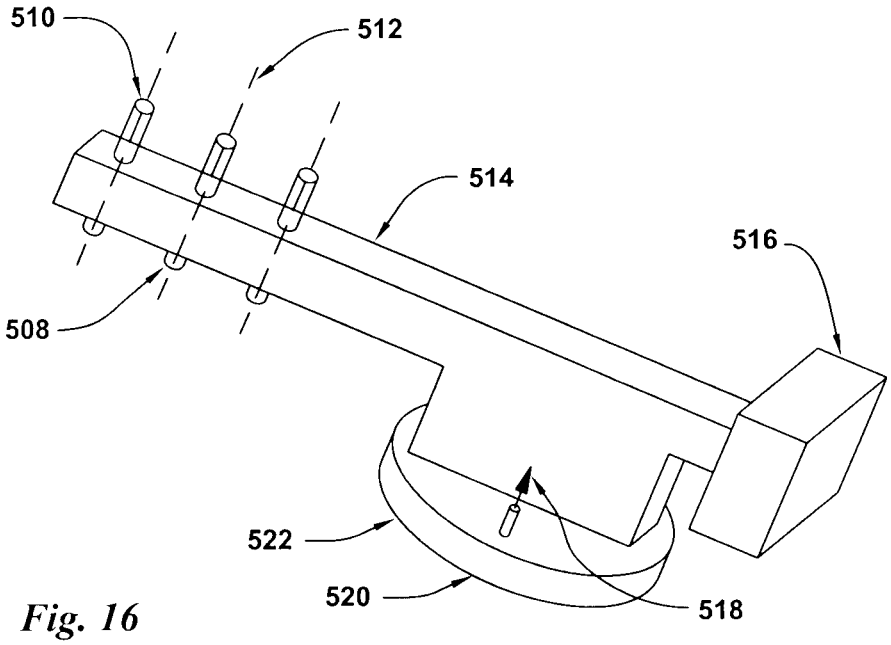
FIG. 16 is a isometric view of a laser arm used to co-planar align workpiece spindles.

FIG. 16 is an isometric view of a laser measurement device arm 514 that is used to co-planar align the top flat surfaces of rotary air bearing or roller bearing workpiece spindles (not shown). The laser measurement arm 514 has an attachment base plate 522 that can be attached in flat-surfaced contact to a precision-flat calibration surface plate (not shown) or to the top flat surface of a rotary alignment spindle (not shown). The weight of the laser measurement device arm 514 is typically sufficient to hold the laser measurement device arm 514 in a stable condition during calibration or measurement procedures. Also, the attachment base plate 522 can be attached to the surface plate with fasteners or the attachment base plate 522 having a precision-flat surface 520 can be attached to a surface plate or rotary alignment spindle with vacuum 518 through vacuum port holes (not shown) that are located in the attachment base plate 522 precision-flat surface 520.

Three laser distance sensors 510 are shown attached in a line along the axis of the laser sensor arm 514 where the laser distance sensors 510 having respective laser beam axes 512 can be used to measure the respective precise laser span distances between the laser sensors 510 bottom laser sensor ends 508 and select targets or selected target areas located on the flat surface of the surface plate or the top flat surfaces of rotary workpiece spindles.

To minimize the torque-force load that is applied by the laser sensor measurement arm 514 that tends to tilt the laser sensor measurement arm 514, a counterbalance weight 516 is attached to the end portion of the lasers sensor arm 514 that is opposed to the end portion of the lasers sensor arm 514 that the laser distance sensors 510 are attached to.

Figure 17:
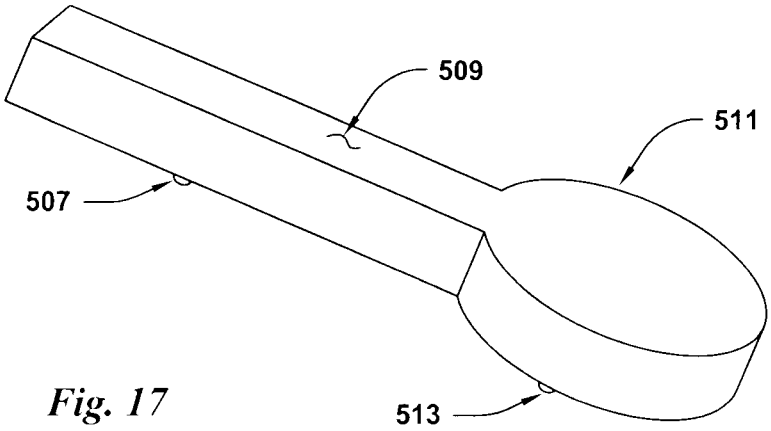
FIG. 17 is a top isometric view of a laser measurement calibration bar.

FIG. 17 is a top isometric view of a laser measurement calibration bar 511 that has a precision-flat calibration surface 509 that a laser measurement device arm (not shown) can be attached to where the precision-flat calibration surface 509 can be used as a reference plane for measuring distances from laser distance sensors (not shown) that are attached to the laser measurement device arm. The flatness accuracy of the precision-flat calibration surface 509 of the laser measurement calibration bar 511 is defined as having out-of-plane variations of less than 0.002 inches but preferably less than 0.0005 inches and most preferably less than 0.0001 inches. The laser measurement calibration bar 511 can be made from granite or cast iron or epoxy-granite to provide dimensional stability for the laser calibration measurements. It has sufficient thickness and widths to provide a lightweight but durable calibration tool.

To assure that the laser measurement calibration bar 511 can be positioned on non-flat mounting surfaces, the laser measurement calibration bar 511 is supported at three points by bar support pads 507 and 513. The laser measurement calibration bar 511 support pads 507 and 513 are attached to the laser measurement calibration bar 511 at fixed positions to assure that the original flatness accuracy of the calibration surface 509 is retained over long periods of time.

Figure 18:
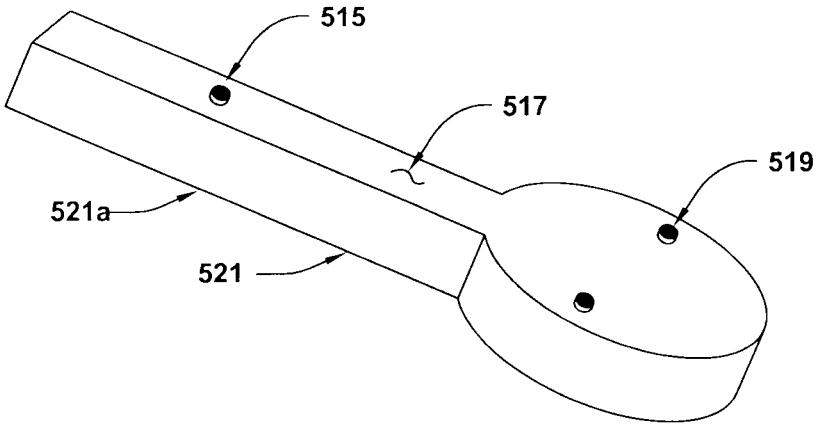
FIG. 18 is a bottom isometric view of a laser measurement calibration bar.

FIG. 18 is a bottom isometric view of a laser measurement calibration bar 521 that has a precision-flat calibration surface 521*a* that a laser measurement device arm (not shown) can be attached to where the precision-flat calibration surface 521*a* can be used as a reference plane for measuring distances from laser distance sensors (not shown) that are attached to the laser measurement device arm. To assure that the laser measurement calibration bar 521 can be positioned on non-flat mounting surfaces, the laser measurement calibration bar 521 is supported at three points by bar support pads 515 and 519 that are attached to the bottom surface 517 of the laser measurement calibration bar 521 The laser measurement calibration bar 521 support pads 515 and 519 that provide stable three-point support of the laser measurement calibration bar 521 are attached to the laser measurement calibration bar 521 at fixed positions to assure that the original flatness accuracy of the calibration surface 521*a* is retained over long periods of time.

Rotating Laser Aligned Workpiece Spindles

Figure 19:
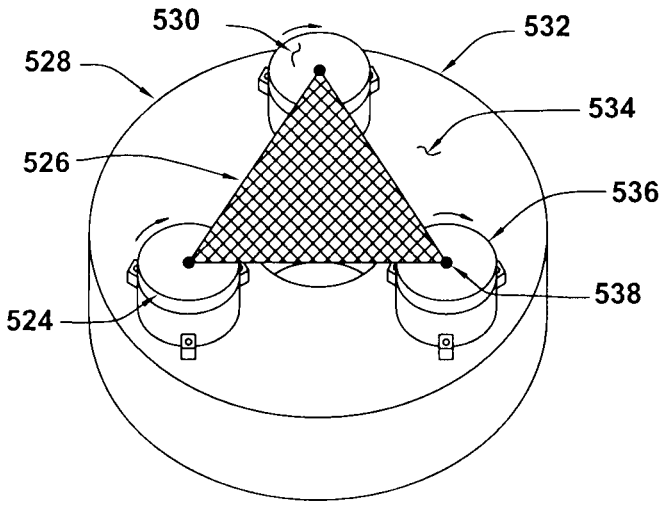
FIG. 19 is an isometric view of co-planar aligned workpiece spindles common plane.

FIG. 19 is an isometric view of three-point co-planar aligned workpiece spindles that have a spindle-common plane where the spindles are mounted on a granite lapper machine base. Three rotary workpiece spindles 536 having rotary spindle-tops 524 that have spindle-top 524 rotational center points 538 where all of the spindle-tops 524 flat surfaces 530 are co-planar as represented by a planar surface 526. The spindles 536 are mounted on a machine base 528. The spindles 536 are attached to the flat surface 534 of a granite, steel, cast iron, epoxy-granite or other base material, machine base 532.

Figure 20:
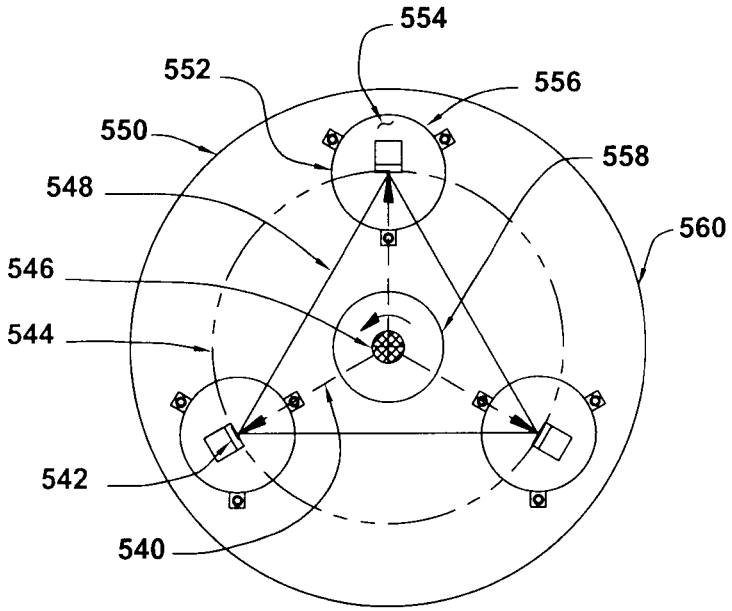
FIG. 20 is a top view of center-position laser aligned rotary workpiece spindles.

FIG. 20 is a top view of three-point center-position laser aligned rotary workpiece spindles on a granite base. Three-point spindles 556 are mounted on a machine base 550 where a rotary laser device 558 having a rotary laser head 546 that sweeps a laser beam 540 in a laser plane circle 544. The rotary laser 558 is mounted on the machine base 550 at a central position between the three spindles 556 to minimize the laser beam 540 distance between the rotary laser head 546 and the reflective laser mirror targets 542 that are mounted on the spindles 556 spindle-top flat surfaces 554. The spindles 556 spindle-top 552 surfaces 554 are aligned to be co-planar with the use of the rotary-beam laser device 558 to form a spindle-top 552 alignment plane 548

Three fixed-position rotary workpiece spindles 556 that are mounted on a granite base are shown being aligned with a L-740 Ultra Precision Leveling Laser 546 provided by Hamar Laser of Danbury, Conn. This laser device 546 has a flatness alignment capability that is approximately three times better than the desired 0.0001 inch (2.5 micron) co-planar spindle-top alignment that is required for high speed flat lapping. Reflective laser minors 542 are respectively mounted at various positions on the flat top surfaces 554 of the respective spindle-tops 552 to reflect a laser beam 540 that is emitted by the rotating laser head 546 back to a laser device 558 sensor (not shown) It is preferred that the rotary laser device 558 is be mounted at a central position between the three spindles 556 to minimize the distance between the reflective minors 542 and the rotating laser beam 540 laser device 558 laser head 546 source. However, the rotary laser device 558 can also be mounted at various positions relative to the three spindles 556 on the granite base where the rotary laser device 558 is not mounted at a central position between the three spindles 556.

Each spindle 556 is independently tilt-adjusted to attain this precision co-planar alignment of the spindle-tops 552 flat surfaces 554 prior to structurally attaching the spindles 556 to the granite base 560. The spindle-tops 552 alignments are retained for long periods of time because of the dimensional stability of the granite base 560. The spindles 556 can be attached directly to the granite base 560 or they can be attached to spindle 556 spherical-action spindle mounts (not shown) after the spindle-tops 552 are aligned to be co-planar to each other.

Figure 21:
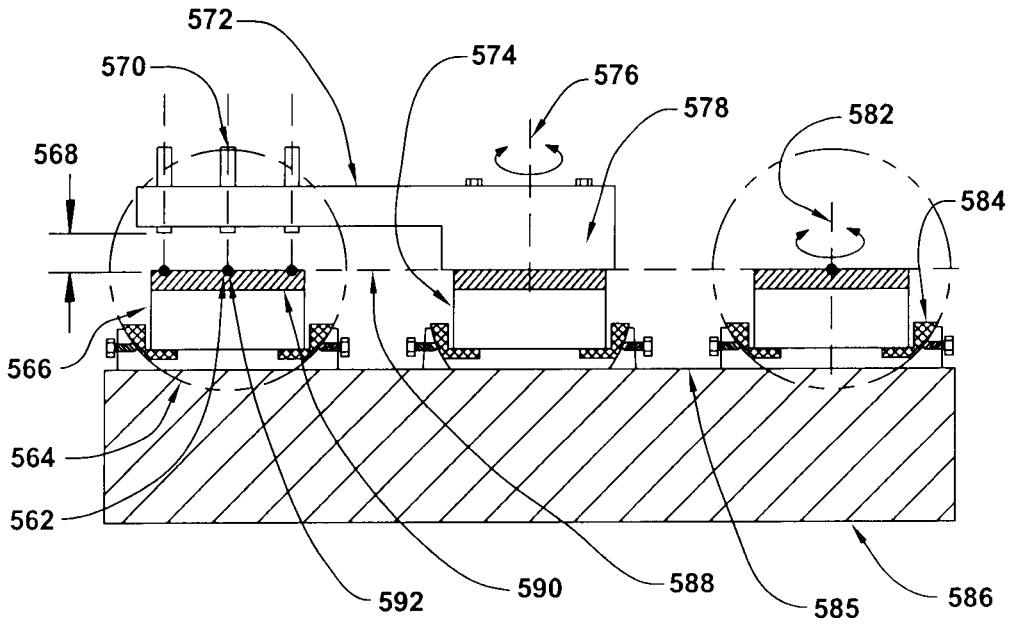
FIG. 21 is a cross section view of air bearing spindles with spherical spindle mounts.

FIG. 21 is a cross section view of an elevated air bearing spindle mounted laser spindle alignment device with spherical spindle mounts. Three air bearing rotary spindles 566, 574 are mounted on a granite lapper machine base 586 having a flat surface 585 where one of the air bearing rotary spindles 566 is selected to be a rotary alignment spindle 574. The air bearing rotary alignment spindle 574 is also mounted on the flat surface 585 of the granite lapper machine base 586.

The rotary workpiece spindles 566 having flat spindle-top surfaces are located at the outer periphery of the circular or rectangular shaped machine base 586 where these workpiece spindles 566 are positioned with near-equal distances between them and they surround the alignment spindle 574. A laser sensor arm 572 is mounted on or attached to the rotary alignment spindle 574 spindle-top 578 where the rotary spindle-top 578 of the alignment spindle 574 can be rotated about an axis 576 to selected positions.

Three laser distance sensors 570 are shown attached to the laser sensor arm 572 where the laser distance sensors 570 having respective laser beam axes can be used to measure the precise laser span distance 568 between the laser sensor 570 bottom laser sensor end and targets 592 located on the flat surfaces of the workpiece spindle's 566 spindle-tops 590. One or more of the three laser distance sensors 570 can also be used to measure the precise laser span distances to select targets that are located on the flat surface of the machine base 586. The select targets that are located on the flat surface of the machine base 586 are typically aligned in a line that extends radially from the center of the machine base 586 so that the laser span distances of all three select targets can be measured simultaneously by the distance measuring sensors 570.

The laser sensor arm 572 that is attached to the top flat surface of the rotary alignment spindle 574 spindle-top 578 can be rotated to align the laser distance sensors 570 with the selected measurement targets 592 located on the surfaces of the workpiece spindles 566 spindle-tops 590 and also to be aligned with targets that are located on the flat surface of the machine base 586.

Each of the workpiece spindles 566, 574 have spherical-action spindle mounts 584 that are rotated to align the top flat surfaces of the workpiece spindle-tops 590 to be co-planar in a plane 588. Each spherical-action spindle mounts 584 has a spherical center of rotation 562 that is coincident with the selected measurement targets 592 located on the surfaces of the workpiece spindles 566 spindle-tops 578, 590 and the spherical-action spindle mounts 584 has a spherical center of rotation 562 that is at the center of the spherical-action sphere 564. Where the spindles 566, 574 are rotated about the spherical center of rotation 562, the distance from the selected measurement targets 592 located on the surfaces of the workpiece spindles 566 spindle-tops 578, 590 and the surface 585 of the machine base 586 remains constant.

Also, the alignment spindle 574 has spherical-action spindle mounts 584 that are rotated to align the flat top surface of the alignment spindle 574 spindle-top 578 to be co-planar with the granite base 586 flat top surface.

The workpiece spindles 566 are rotated about an axis 582 to incremental positions or the workpiece spindles 566 are rotated about an axis 582 at rotational speeds when the laser span distances 568 are measured to provide span distance 568 measurements having improved-accuracy dynamic readings by averaging multiple target 592 points on the surface of the spindle-tops 590 as the spindle-tops 590 are rotated. The granite construction material of the machine base 586 provides long term dimensional stability and rigidity that allows the workpiece spindle's 566 spindle-tops 590 precision co-planar alignment to be maintained over long periods of time even when the workpiece spindles 566 spindle are subjected to abrading forces during flat lapping operations.

Figure 22:
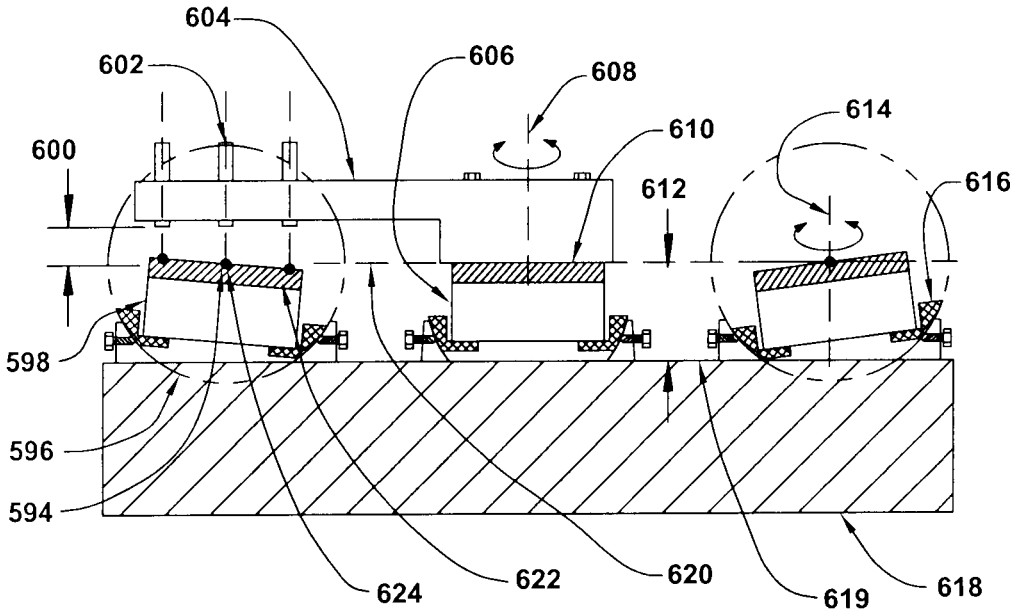
FIG. 22 is a cross section view of tilted air bearing spindles with spherical spindle mounts.

FIG. 22 is a cross section view of an air bearing spindle mounted laser spindle alignment device with spherical spindle mounts and tilted spindles. Three air bearing rotary spindles 598, 606 are mounted on a granite lapper machine base 618 having a flat surface 585 where one of the air bearing rotary spindles 598 is selected to be a rotary alignment spindle 606. The air bearing rotary alignment spindle 606 is also mounted on the flat surface 585 of the granite lapper machine base 618.

The rotary workpiece spindles 598 having flat spindle-top surfaces are located at the outer periphery of the circular or rectangular shaped machine base 618 where these workpiece spindles 598 are positioned with near-equal distances between them and they surround the alignment spindle 606. A laser sensor arm 604 is mounted on or attached to the rotary alignment spindle 606 spindle-top 610 where the rotary spindle-top 610 of the alignment spindle 606 can be rotated about an axis 608 to selected positions.

Three laser distance sensors 602 are shown attached to the laser sensor arm 604 where the laser distance sensors 602 having respective laser beam axes can be used to measure the precise laser span distance 600 between the laser sensor 602 bottom laser sensor end and targets 624 located on the flat surfaces of the workpiece spindle's 598 spindle-tops 622. One or more of the three laser distance sensors 602 can also be used to measure the precise laser span distances to select targets that are located on the flat surface of the machine base 618. The select targets that are located on the flat surface of the machine base 618 are typically aligned in a line that extends radially from the center of the machine base 618 so that the laser span distances of all three select targets can be measured simultaneously by the distance measuring sensors 602.

The laser sensor arm 604 that is attached to the top flat surface of the rotary alignment spindle 606 spindle-top 610 can be rotated to align the laser distance sensors 602 with the selected measurement targets 624 located on the surfaces of the workpiece spindles 598 spindle-tops 622 and also to be aligned with targets that are located on the flat surface of the machine base 618.

Each of the workpiece spindles 598, 606 have spherical-action spindle mounts 616 that are rotated to align the top flat surfaces of the workpiece spindle-tops 622 to be co-planar in a plane 620. Each spherical-action spindle mounts 616 has a spherical center of rotation 594 that is coincident with the selected measurement targets 624 located on the surfaces of the workpiece spindles 598 spindle-tops 610, 622 and the spherical-action spindle mounts 616 has a spherical center of rotation 594 that is at the center of the spherical-action sphere 596. Where the tilted spindles 598 are rotated about the spherical center of rotation 594, the distance 612 from the selected measurement targets 624 located on the surfaces of the workpiece spindles 598 spindle-tops 622 and the surface 619 of the machine base 618 remains constant.

Also, the alignment spindle 606 has spherical-action spindle mounts 616 that are rotated to align the flat top surface of the alignment spindle 606 spindle-top 610 to be co-planar with the granite base 618 flat top surface. The workpiece spindles 598 are rotated about an axis 614 to incremental positions or the workpiece spindles 598 are rotated about an axis 614 at rotational speeds when the laser span distances 600 are measured to provide span distance 600 measurements having improved-accuracy dynamic readings by averaging multiple target 624 points on the surface of the spindle-tops 622 as the spindle-tops 622 are rotated. The granite construction material of the machine base 618 provides long term dimensional stability and rigidity that allows the workpiece spindle's 598 spindle-tops 622 precision co-planar alignment to be maintained over long periods of time even when the workpiece spindles 598 spindle are subjected to abrading forces during flat lapping operations.

Laser Alignment Apparatus Description

An at least three-point, fixed-spindle floating-platen abrading machine alignment apparatus is described comprising:

a) at least three rotary workpiece spindles having rotatable flat-surfaced spindle-tops, each of the rotary spindle-tops having a respective rotary spindle-top axis of rotation at the center of a respective rotatable flat-surfaced rotary spindle-top for each respective rotary workpiece spindles;

b) wherein a respective axis of rotation for each of the at least three workpiece rotary spindle-tops' is perpendicular to the respective rotary spindle-tops' flat surface;

c) an abrading machine base having a horizontal, nominally-flat top surface and a spindle-circle where the spindle-circle is coincident with the machine base nominally-flat top surface;

d) the at least three rotary workpiece spindles are located with near-equal spacing between the respective at least three rotary workpiece spindles where the respective at least three rotary spindle-tops' axes of rotation intersect the machine base spindle-circle and where the respective at least three rotary workpiece spindles are mechanically attached to the machine base top surface;

e) the at least three workpiece rotary spindle-tops' flat surfaces are configured to be adjustably alignable to be co-planar with each other;

f) a distance measurement arm device where the distance measurement arm device is mounted on or attached to a selected workpiece spindle rotary spindle-top wherein the non-selected rotary workpiece spindles are non-selected workpiece spindles;

g) at least one distance measurement sensor is attached to the distance measurement arm device;

h) wherein the at least one distance measurement sensors are attached at respective positions on the distance measurement arm to provide distance measurements to be made from the respective at least one distance measurement sensors to selected target points on the respective surfaces of the non-selected workpiece spindle's rotary spindle-tops or to selected target points on the machine base top surface;

i) the selected workpiece spindle is configured to allow the at least one distance measurement sensors measurement distances from the respective at least one distance sensors to respective selected target points on the respective surfaces of the non-selected workpiece spindles' rotary spindle-tops used to co-planar align the flat surfaces of the at least three workpiece spindle's rotary spindle-tops.

This abrading machine alignment apparatus can also have a machine base having a structural material selected from the group consisting of granite, epoxy-granite, and metal and wherein the machine base structural material and the machine base structural material is either a non-porous solid or is a solid material that is temperature controlled by a temperature-controlled fluid that circulates in fluid passageways internal to the machine base structural materials. Further, the apparatus can be configured where the at least three rotary workpiece spindles are air bearing rotary workpiece spindles.

Also, the apparatus distance measurement sensors are selected from the group consisting of laser distance sensors, capacitance sensors, eddy current sensors, mechanical measurement devices, dial-indicator measurement devices, air-gap sensors and ultrasonic distance sensors.

In addition, the apparatus can be configured where the selected workpiece spindle allows the selected workpiece spindle rotary spindle-top and the mounted or attached distance measurement arm device to be rotated to fixed locations where the at least one distance measurement sensors are positioned to measure the distances from the respective at least one distance sensors to respective selected target points on the surface of the machine base wherein the at least one distance measurement sensors measurement distances from the respective at least one distance sensors to respective selected target points on the surface of the machine base are used to align the flat surface of the selected workpiece spindle rotary spindle-top parallel to the surface of the machine base.

Further, this same apparatus can be configured where the selected distance measurement sensors target points on the respective surfaces of the non-selected workpiece spindle's rotary spindle-tops or the selected target points on the machine base top surface are target areas or the selected distance measurement sensors target points on the respective surfaces of the non-selected workpiece spindle's rotary spindle-tops or the selected target points on the machine base top surface are reflective target devices. And, the distance measurement arm device of the apparatus is mounted on or attached to the selected workpiece spindle rotary spindle-top by a technique selected from the group consisting of vacuum attachment, adhesives attachment, mechanical fastener attachment or using the weight of the distance measurement arm device to provide attachment. Further, the distance measurement arm device can be a dual-arm device where two distance measurement arms extend out in two opposed directions from the selected workpiece spindle rotary spindle-top wherein at least one distance measurement sensor is attached to each of the dual-arm distance measurement arm device distance measurement arms.

A process of providing alignment of an at least three-point, fixed-spindle floating-platen abrading machine alignment apparatus is described comprising:

a) providing at least three rotary workpiece spindles having rotatable flat-surfaced rotary spindle-tops that each have a rotary spindle-top axis of rotation at the center of a respective rotatable flat-surfaced rotary spindle-top for each respective rotary workpiece spindles;

b) providing that the at least three workpiece rotary spindle-tops' axes of rotation are perpendicular to the respective workpiece rotary spindle-tops' flat surfaces;

c) providing an abrading machine base having a horizontal, nominally-flat top surface and a spindle-circle where the spindle-circle is coincident with the machine base nominally-flat top surface;

d) positioning the at least three rotary workpiece spindles in locations with nominally-equal spacing between the respective at least three of the rotary workpiece spindles where the respective at least three workpiece rotary spindle-tops' axes of rotation intersect the machine base spindle-circle and where the respective at least three rotary workpiece spindles are mechanically attached to the machine base top surface;

e) providing a distance measurement arm device where the distance measurement arm device is mounted on or attached to a selected workpiece spindle rotary spindle-top wherein the non-selected rotary workpiece spindles are non-selected workpiece spindles;

f) providing at least one distance measurement sensor that is attached to the distance measurement arm device;

g) attaching the at least one distance measurement sensors at respective positions on the distance measurement arm to provide distance measurements to be made from the respective at least one distance measurement sensors to selected target points on the respective surfaces of the non-selected workpiece spindle's rotary spindle-tops or to selected target points on the machine base top surface;

h) aligning the at least three workpiece spindles' rotary spindle-tops' flat surfaces so that they are co-planar with each other by use of the at least one distance measurement sensors measurement distances from the respective at least one distance sensors to respective selected target points on the respective surfaces of the at least three workpiece spindle's rotary spindle-tops.

This same process is described where the at least three rotary workpiece spindles are air bearing rotary workpiece spindles and where the distance measurement sensors are selected from the group consisting of laser distance sensors, capacitance sensors, eddy current sensors, mechanical measurement devices, dial-indicator measurement devices, air-gap sensors or ultrasonic distance sensors.

Further, the same process is described where the selected workpiece spindle rotary spindle-top and the mounted or attached distance measurement arm device is rotated to fixed locations where the at least one distance measurement sensors from which the distances are measured from the respective at least one distance sensors to respective selected target points on the surface of the machine base wherein the at least one distance measurement sensors measurement distances from the respective at least one distance sensors to respective selected target points on the surface of the machine base are used to align the flat surface of the selected workpiece spindle rotary spindle-top parallel to the surface of the machine base.

In addition the same process is described where the selected distance measurement sensors target points on the respective surfaces of the no-selected workpiece spindle's rotary spindle-tops or the selected target points on the machine base top surface are target areas or the selected distance measurement sensors target points on the respective surfaces of the non-selected workpiece spindle's rotary spindle-tops or the selected target points on the machine base top surface are reflective target devices. Also, in this process, the distance measurement arm device can be mounted on or attached to the selected workpiece spindle rotary spindle-top by a technique selected from the group consisting of vacuum attachment, adhesives attachment, mechanical fastener attachment or using the weight of the distance measurement arm device to provide attachment.

Another process is described of providing alignment of an at least three-point, fixed-spindle floating-platen abrading machine alignment apparatus comprising:

a) providing at least three rotary workpiece spindles having rotatable flat-surfaced rotary spindle-tops that each have a rotary spindle-top axis of rotation at the center of a respective rotatable flat-surfaced rotary spindle-top for each respective rotary workpiece spindles;

b) providing that the at least three workpiece rotary spindle-tops' axes of rotation are perpendicular to the respective workpiece rotary spindle-tops' flat surfaces;

c) providing an abrading machine base having a horizontal, nominally-flat top surface and a spindle-circle where the spindle-circle is coincident with the machine base nominally-flat top surface;

d) positioning the at least three rotary workpiece spindles in locations with nominally-equal spacing between the respective at least three of the rotary workpiece spindles where the respective at least three workpiece rotary spindle-tops' axes of rotation intersect the machine base spindle-circle and where the respective at least three rotary workpiece spindles are mechanically attached to the machine base top surface;

e) providing a distance measurement arm device where the distance measurement arm device is mounted on or attached to a selected workpiece spindle rotary spindle-top wherein the non-selected rotary workpiece spindles are non-selected workpiece spindles;

f) providing at least one distance measurement sensor that is attached to the distance measurement arm device;

g) attaching the at least one distance measurement sensors at respective positions on the distance measurement arm to provide distance measurements to be made from the respective at least one distance measurement sensors to selected target points on the selected target points on the machine base top surface;

i) aligning the flat surface of the selected workpiece spindle rotary spindle-top to be parallel to the top surface of the abrading machine by use of the at least one distance measurement sensors measurement distances from the respective at least one distance sensors to respective selected target points on the machine base top surface.

In this process, the at least three rotary workpiece spindles cab be air bearing rotary workpiece spindles and the distance measurement sensors are selected from the group consisting of laser distance sensors, capacitance sensors, eddy current sensors, mechanical measurement devices, dial-indicator measurement devices, air-gap sensors or ultrasonic distance sensors. Further, in this process, the selected workpiece spindle rotary spindle-top and the mounted or attached distance measurement arm device can be rotated to fixed locations where the at least one distance measurement sensors from which the distances are measured from the respective at least one distance sensors to respective selected target points on the surface of the machine base wherein the at least one distance measurement sensors measurement distances from the respective at least one distance sensors to respective selected target points on the surface of the machine base are used to align the flat surface of the selected workpiece spindle rotary spindle-top parallel to the surface of the machine base.

In another embodiment of the process, the selected distance measurement sensors target points on the respective surfaces of the no-selected workpiece spindle's rotary spindle-tops or the selected target points on the machine base top surface are target areas or the selected distance measurement sensors target points on the respective surfaces of the non-selected workpiece spindle's rotary spindle-tops or the selected target points on the machine base top surface are reflective target devices. Further, the distance measurement arm device can be mounted on or attached to the selected workpiece spindle rotary spindle-top by a technique selected from the group consisting of vacuum attachment, adhesives attachment, mechanical fastener attachment or using the weight of the distance measurement arm device to provide attachment.

What is claimed:

1. An at least three-point, fixed-spindle floating-platen abrading machine alignment apparatus comprising:

a) at least three rotary workpiece spindles having rotatable flat-surfaced spindle-tops, each of the rotary spindle-tops having a respective rotary spindle-top axis of rotation at the center of a respective rotatable flat-surfaced rotary spindle-top for each respective rotary workpiece spindles;

b) wherein a respective axis of rotation for each of the at least three workpiece rotary spindle-tops' is perpendicular to respective rotary spindle-tops' flat surface;

c) an abrading machine base having a horizontal, nominally-flat top surface and a spindle-circle where the spindle-circle is coincident with the machine base nominally-flat top surface;

d) the at least three rotary workpiece spindles being located with near-equal spacing between the respective at least three rotary workpiece spindles where respective at least three rotary spindle-tops' axes of rotation intersect the machine base spindle-circle and where respective at least three rotary workpiece spindles are attached to the machine base top surface;

e) the at least three workpiece rotary spindle-tops' flat surfaces are configured to be adjustably alignable to be co-planar with each other;

f) a distance measurement arm device mounted on or attached to a selected workpiece spindle rotary spindle-top wherein non-selected rotary workpiece spindles are non-selected workpiece spindles;

g) at least one distance measurement sensor is attached to the distance measurement arm device;

h) wherein the at least one distance measurement sensor is attached at a respective position on the distance measurement arm to provide distance measurements to be made from the respective at least one distance measurement sensor to selected target points on the respective surfaces of the non-selected workpiece spindle's rotary spindle-tops or to selected target points on the machine base top surface;

i) the selected workpiece spindle is configured to allow the at least one distance measurement sensor measurement distances from the respective at least one distance sensor to respective selected target points on the respective surfaces of the non-selected workpiece spindles' rotary spindle-tops used to co-planar align the flat surfaces of the at least three workpiece spindle's rotary spindle-tops;

i) the at least three rotary workpiece spindles are configured to allow locking of the co-planar aligned at least three workpiece spindles in their co-planar aligned positions.

2. The apparatus of claim 1 wherein the machine base comprises a structural material selected from the group consisting of granite, epoxy-granite, and metal and wherein the machine base structural material and the machine base structural material is either a non-porous solid or is a solid material that is temperature controlled by a temperature-controlled fluid that circulates in fluid passageways internal to the machine base structural materials.

3. The apparatus of claim 1 wherein the at least three rotary workpiece spindles are air bearing rotary workpiece spindles.

4. The apparatus of claim 1 wherein the at least one distance measurement sensor is selected from the group consisting of laser distance sensors, capacitance sensors, eddy current sensors, mechanical measurement devices, dial-indicator measurement devices, air-gap sensors and ultrasonic distance sensors.

5. The apparatus of claim 1 wherein the selected workpiece spindle is configured to allow the selected workpiece spindle rotary spindle-top and the mounted or attached distance measurement arm device to be rotated to fixed locations where the at least one distance measurement sensor is positioned to measure the distances from the respective at least one distance sensor to respective selected target points on the surface of the machine base wherein the at least one distance measurement sensor's measurement distances from the respective at least one distance sensors to respective selected target points on the surface of the machine base are used to align the flat surface of the selected workpiece spindle rotary spindle-top parallel to the surface of the machine base.

6. The apparatus of claim 1 wherein the at least one selected distance measurement sensor's target points on the respective surfaces of the non-selected workpiece spindle's rotary spindle-tops or the selected target points on the machine base top surface are target areas or the selected distance measurement sensors target points on the respective surfaces of the non-selected workpiece spindle's rotary spindle-tops or the selected target points on the machine base top surface are reflective target devices.

7. The apparatus of claim 1 wherein the distance measurement arm device is mounted on or attached to the selected workpiece spindle rotary spindle-top by a technique selected from the group consisting of vacuum attachment, adhesives attachment, mechanical fastener attachment or using the weight of the distance measurement arm device to provide attachment.

8. The apparatus of claim 1 wherein the distance measurement arm device is a dual-arm device where two distance measurement arms extend out in two opposed directions from the selected workpiece spindle rotary spindle-top wherein at least one distance measurement sensor is attached to each of the dual-arm distance measurement arm device distance measurement arms.

9. A process of providing alignment of an at least three-point, fixed-spindle floating-platen abrading machine alignment apparatus comprising:

a) providing at least three rotary workpiece spindles having rotatable flat-surfaced rotary spindle-tops that each have a rotary spindle-top axis of rotation at the center of a respective rotatable flat-surfaced rotary spindle-top for each respective rotary workpiece spindles;

b) providing that the at least three workpiece rotary spindle-tops' axes of rotation are perpendicular to the respective workpiece rotary spindle-tops' flat surfaces;

c) providing an abrading machine base having a horizontal, nominally-flat top surface and a spindle-circle where the spindle-circle is coincident with the machine base nominally-flat top surface;

d) positioning the at least three rotary workpiece spindles in locations with nominally-equal spacing between the respective at least three of the rotary workpiece spindles where the respective at least three workpiece rotary spindle-tops' axes of rotation intersect the machine base spindle-circle and where the respective at least three rotary workpiece spindles are mechanically attached to the machine base top surface;

e) providing that the at least three rotary workpiece spindles are configured to allow locking of the at least three workpiece spindles in their aligned positions;

f) providing a distance measurement arm device where the distance measurement arm device is mounted on or attached to a selected workpiece spindle rotary spindle-top wherein the non-selected rotary workpiece spindles are non-selected workpiece spindles;

g) providing at least one distance measurement sensor that is attached to the distance measurement arm device;

h) attaching the at least one distance measurement sensors at a respective position on the distance measurement arm to provide distance measurements to be made from the respective at least one distance measurement sensor to selected target points on the respective surfaces of the non-selected workpiece spindle's rotary spindle-tops or to selected target points on the machine base top surface;

i) aligning the at least three workpiece spindles' rotary spindle-tops' flat surfaces so that they are co-planar with each other by use of the at least one distance measurement sensor's measurement distances from the respective at least one distance sensor to respective selected target points on the respective surfaces of the non-selected workpiece spindle's rotary spindle-tops;

j) locking the co-planar aligned at least three workpiece spindles in their co-planar aligned positions.

10. The process of claim 9 wherein the at least three rotary workpiece spindles are air bearing rotary workpiece spindles.

11. The process of claim 9 wherein the distance measurement sensors are selected from the group consisting of laser distance sensors, capacitance sensors, eddy current sensors, mechanical measurement devices, dial-indicator measurement devices, air-gap sensors or ultrasonic distance sensors.

12. The process of claim 9 wherein the co-planar alignment of the at least three workpiece spindles' rotary spindle-tops' flat surfaces so that they are co-planar with each other is repeated at least one more times by using the same selected workpiece spindle for attachment of the measurement arm device or by selecting another of the workpiece spindles for attachment of the measurement arm device to progressively decrease the out-of-plane dimensional variations of the co-planar alignment of the at least three workpiece spindles' rotary spindle-tops' flat surfaces.

13. The process of claim 9 wherein the selected distance measurement sensor's target points on the respective surfaces of the no-selected workpiece spindle's rotary spindle-tops or the selected target points on the machine base top surface are target areas or the selected distance measurement sensor's target points on the respective surfaces of the non-selected workpiece spindle's rotary spindle-tops or the selected target points on the machine base top surface are reflective target devices.

14. The process of claim 9 wherein the distance measurement arm device is mounted on or attached to the selected workpiece spindle rotary spindle-top by a technique selected from the group consisting of vacuum attachment, adhesives attachment, mechanical fastener attachment or using the weight of the distance measurement arm device to provide attachment.

15. A process of providing alignment of an at least three-point, fixed-spindle floating-platen abrading machine alignment apparatus comprising:

a) providing at least three rotary workpiece spindles having rotatable flat-surfaced rotary spindle-tops that each have a rotary spindle-top axis of rotation at the center of a respective rotatable flat-surfaced rotary spindle-top for each respective rotary workpiece spindle;

b) providing that the at least three workpiece rotary spindle-tops' axes of rotation are perpendicular to the respective workpiece rotary spindle-tops' flat surface;

c) providing an abrading machine base having a horizontal, nominally-flat top surface and a spindle-circle where the spindle-circle is coincident with the machine base nominally-flat top surface;

d) positioning the at least three rotary workpiece spindles in locations with nominally-equal spacing between the respective at least three of the rotary workpiece spindles where the respective at least three workpiece rotary spindle-tops' axes of rotation intersect the machine base spindle-circle and where the respective at least three rotary workpiece spindles are mechanically attached to the machine base top surface;

e) providing that the at least three rotary workpiece spindles are configured to allow locking of the at least three workpiece spindles in their aligned positions;

f) providing a distance measurement arm device mounted on or attached to a selected workpiece spindle rotary spindle-top wherein there are non-selected workpiece spindles;

g) providing at least one distance measurement sensor that is attached to the distance measurement arm device;

h) attaching the at least one distance measurement sensors at respective positions on the distance measurement arm to provide distance measurements to be made from the respective at least one distance measurement sensors to selected target points on the selected target points on the machine base top surface;

i) aligning the flat surface of the selected workpiece spindle rotary spindle-top to be parallel to the top surface of the abrading machine base by use of the at least one distance measurement sensors measurement distances from the respective at least one distance sensors to respective selected target points on the machine base top surface; and j) locking the co-planar aligned at least three workpiece spindles in their co-planar aligned positions.

16. The process of claim 15 wherein the at least three rotary workpiece spindles are air bearing rotary workpiece spindles.

17. The process of claim 15 wherein the at least one distance measurement sensor is selected from the group consisting of laser distance sensors, capacitance sensors, eddy current sensors, mechanical measurement devices, dial-indicator measurement devices, air-gap sensors or ultrasonic distance sensors.

18. The process of claim 15 wherein the parallel alignment of the selected workpiece spindle's rotary spindle-top's flat surface with the surface of the machine base is repeated at least one time to progressively decrease the non-parallel dimensional variations of the parallel alignment of the selected workpiece spindle's rotary spindle-top's flat surface with the surface of the machine base.

19. The process of claim 15 wherein the selected distance measurement sensors target points on the respective surfaces of the non-selected workpiece spindle's rotary spindle-tops or the selected target points on the machine base top surface are target areas or the selected distance measurement sensors target points on the respective surfaces of the non-selected workpiece spindle's rotary spindle-tops or the selected target points on the machine base top surface are reflective target devices.

20. The process of claim 15 wherein the distance measurement arm device is mounted on or attached to the selected workpiece spindle rotary spindle-top by a technique selected from the group consisting of vacuum attachment, adhesives attachment and mechanical fastener attachment.

* * * * *